United States Patent [19]

Scheiber

[11] Patent Number: 4,704,728

[45] Date of Patent: Nov. 3, 1987

[54] SIGNAL RE-DISTRIBUTION, DECODING AND PROCESSING IN ACCORDANCE WITH AMPLITUDE, PHASE, AND OTHER CHARACTERISTICS

[76] Inventor: Peter Scheiber, 152 Bayview Ave., Northport, N.Y. 11768

[21] Appl. No.: 687,860

[22] Filed: Dec. 31, 1984

[51] Int. Cl.[4] ..... H04R 5/00

[52] U.S. Cl. ..... 381/22

[58] Field of Search ..... 381/17, 18, 19, 21, 381/24, 23

[56] References Cited

U.S. PATENT DOCUMENTS

| | | | |
|---|---|---|---|
| 3,632,886 | 1/1972 | Scheiber | 381/23 |
| 3,746,792 | 7/1973 | Scheiber | 381/23 |
| 3,772,479 | 11/1973 | Hilbert | 381/18 |
| 3,934,086 | 1/1976 | Takahashi | 381/21 |
| 3,944,735 | 3/1976 | Willcocks | 381/20 |
| 3,959,590 | 5/1976 | Scheiber | 381/22 |
| 4,027,101 | 5/1977 | De Freitas et al. | 381/18 |
| 4,236,039 | 11/1980 | Cooper | 381/23 |

FOREIGN PATENT DOCUMENTS

| | | |
|---|---|---|
| 1205151 | 7/1965 | Fed. Rep. of Germany . |
| 363627 | 4/1931 | United Kingdom . |
| 361468 | 5/1931 | United Kingdom . |
| 362472 | 7/1931 | United Kingdom . |
| 394325 | 1/1933 | United Kingdom . |
| 417718 | 9/1934 | United Kingdom . |
| 429054 | 2/1935 | United Kingdom . |
| 456444 | 11/1936 | United Kingdom . |
| 852285 | 4/1960 | United Kingdom . |
| 999765 | 4/1965 | United Kingdom . |
| 1112233 | 3/1968 | United Kingdom . |

OTHER PUBLICATIONS

Clark et al., J. Aud. Eng. Soc., Apr. 1958, "The 'Stereosnic' Recording and Reproducing System".

Scheiber–J. Aud. Eng. Soc., Nov. 1971, "Analysing Phase–Amplitude Matrices".

BBC Research Department, 1974, p. 19, Appendix, "The Subjective Performance of Various Quadraphonic Matrix Systems".

J. Eargle, J. Aud. Eng. Soc., Dec. 1972, "4–2–4 Matrix Systems".

Dolby Laboratories Corporation, Dec. 1984, pp. 1–6, "Dolby Laboratories Licensing Corp., Field Bulletin No. 138".

*Primary Examiner*—Forester W. Isen

*Attorney, Agent, or Firm*—Robert R. Keegan

[57] ABSTRACT

Decoding apparatus is disclosed providing desirable multichannel separation among various signals received in a channel pair and distinguished by relative phase and amplitude, including re-distribution of output vs. input signal nulls or positions on the "phase-amplitude sphere." Disclosed separation enhancement circuits are characterized by improved economy and signal purity. Enhancement is preferably controlled within the circuit by combination of gain-controlled enhancement signals with fixed matrix signals in summing amplifiers or the like. In some embodiments the enhancement signal for one output channel is modified to produce a different enhancement signal for a different output channel. In such separation enhancement, alternatives to the preferred-embodiment variable-gain element may include such commercial devices as expander or noise-reduction chips. Derivation of control voltages for controlling separation enhancement is characterized by economical sensing of various program characteristics such as phase, amplitude and program level changes, and may for example include log ratio direction-sensing circuits. Control-voltage processing in response to sensed program characteristics provides improved smoothness of operation and freedom from anomalous operation. In one embodiment, circuits providing a choice between "panoramic" or "surround" reproduction and "ambience" reproducion of stereo program are disclosed. In another embodiment, optimal multidirectional separation-enhanced decoding for cinema or video sound is obtained with the use of a single variable-gain element.

7 Claims, 22 Drawing Figures

Figure 1:
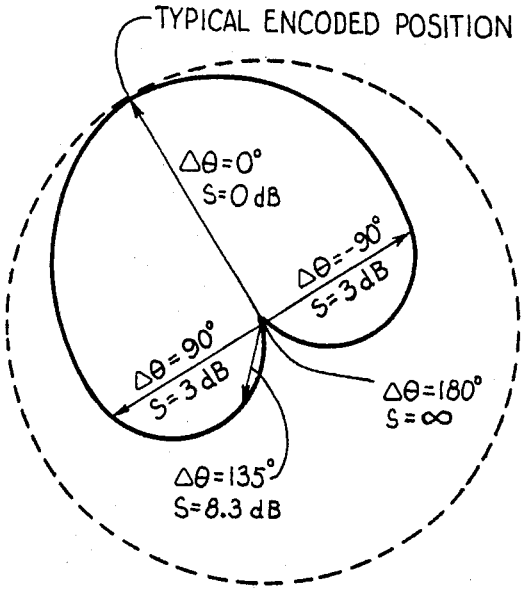
Figure 2A:
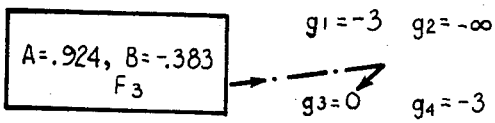
FIG. 2a PRIOR ART
Figure 3A:
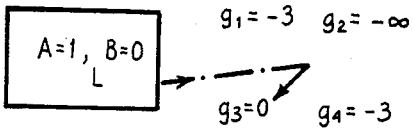
Figure 2B:
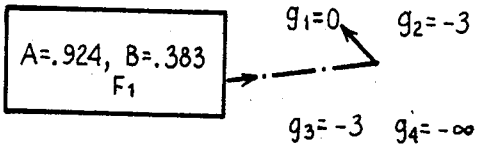
FIG. 2b PRIOR ART
Figure 3B:
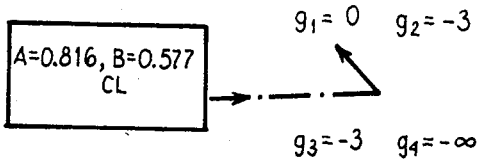
Figure 2C:
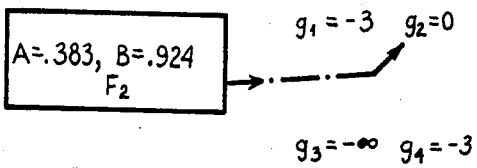
FIG. 2c PRIOR ART
Figure 3C:
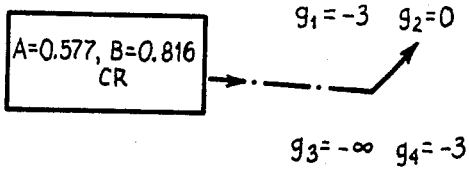
Figure 2D:
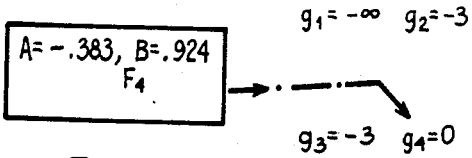
FIG. 2d PRIOR ART
Figure 3D:
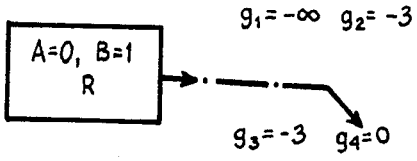

SIGNAL RE-DISTRIBUTION, DECODING AND PROCESSING IN ACCORDANCE WITH AMPLITUDE, PHASE, AND OTHER CHARACTERISTICS

The present invention relates to an improved multichannel signal redistribution apparatus (decoder) responding to relative amplitudes, phases and other program characteristics or control signals.

In two-channel stereophonic systems, a sound program is conveyed using two independent channels which may be designated "A" and "B". These channels are separately recorded and/or transmitted so as to maintain mutual independence, and are generally reproduced by supplying each one to a corresponding loudspeaker. A particular sound source or "directional signal" in the program may appear to be located at either of the two loudspeakers or at any point in between, thereby providing a more realistic re-creation of the program than is available from a monophonic system.

A system in which the location of a sound is confined to the area between two speakers, however, cannot provide the sensations of a live sonic event in which sounds may be clearly localized in any direction around the listener. Because of this inadequacy, various multichannel systems have been devised. In some of the systems, each channel is fully independent with a sound program being recorded or transmitted as three or more independent channels that are ultimately applied to separate loudspeakers. In other systems, such as those described in my U.S. Pat. Nos. 3,632,886, 3,746,792 and 3,959,590, which are incorporated herein by reference, the information from at least three channels or directional signals may be encoded into two independent channels, and at least three output signals may then be decoded from the two independent channels to drive several loudspeakers. For example, to encode four directional signals, some of the four signals are split into first and second signal components in an "encoder" that introduces a relative phase difference in at least some pairs of the components. The first components are then combined to form one of the two encoded channel signals, while the second components are combined to form the second of the two encoded channel signals. The encoded signals may then be decoded to reproduce predominantly the original directional signals by applying a "decoder" which generates specified phase and amplitude combinations of the encoded channel signals. Such an encode/decode system, known as a "matrix system" or a "4-2-4 system", is compatible with most commercial two-channel formats, such as FM, AM and television audio broadcast; audio and audio-with-video recordings; and film sound tracks and equipment.

A typical multichannel reproduction system may use for example four loudspeakers designated LF, RF, LB and RB. The listener commonly faces the front speakers LF and RF. It is common in practice for listener seating to be generally closer to the LB and RB than to the LF and RF speakers.

The advantages of multichannel sound systems over conventional stereophonic systems is apparent when one appreciates that the conventional systems can clearly localize sound sources (directional signals) only within an angle of substantially less than 180 degrees; whereas multichannel systems expand this directionality potentially to encompass the listening space, as in the live sonic event. The improved relism and impact of multichannel sound over conventional stereophonic sound is fully borne out by actual experience.

A great proportion of recorded and other music is available only in a conventional (unencoded) stereophonic format. It is, however, desirable to be able to enjoy many of such programs on an audio system that provides some of the above-described advantages.

In some applications, notably automotive use, the two channels of the stereo program are supplied to two pairs of speakers; such systems, however, whether "crossed stereo" or simply doubled stereo, are inferior, rather than superior to conventional two-speaker systems in ability to localize individual sound sources, since each sound source in the stereo program is simultaneously reproduced from two different locations.

Other systems employ only two speakers, using cross-blending between the stereo channels with controlled phase, delay and/or frequency response to create phantom images outside the speaker area. Such phantom images tend to be vague and unstable, particularly for the off-center listener.

Delay-type systems may reproduce the stereo program through a front speaker pair, reproducing the program with added time delay through added rear speakers. Such systems simulate reverberation or "ambience" associated with live sound events. They cannot, however, localize sounds to the sides and rear of the listening area. Further, the resulting ambience effect is not actual ambience information derived from the program and resulting from the reverberation characterizing the original performance space, but is an electronic simulation added ex post facto. Further, though such systems have provided "incoherence", or a quasi-random phase relationship between the signals reproduced by the rear speakers, there is no genuine separation between these rear speakers in the sense of different program signals being supplied to the individual rear speakers; rather, the same signal is supplied merely delayed in differing degrees.

Simple ambience recovery systems which feed a subtractive combination of stereo left and right signals to rear "ambience" speakers likewise frequently provide no separation between the individual rear speakers. Where a small degree of separation is provided by providing a "left-heavy" subtractive mix to a left back speaker, and a "right-heavy" mix to a right back speaker, rejection of stereo center program signals in the rear speakers is reduced, which is problematic in that stereo center traditionally is the most frequent location for vocal or other solo signals; and is further the location farthest in space from (diametrically opposite) the mean position of the rear "ambience" speakers, which emphasizes the audibility of such "crosstalk."

"Quadraphonic" decoders frequently included a "synthesized quad" function for surround reproduction of conventional stereo program. In such decoders, a "pre-encoding" matrix employing all-pass phase shift networks was usually added at the input of a decoder designed primarily to decode previously encoded program, increasing costs and frequently providing compromised performance in surround reproduction of stereophonic, in comparison with intended encoded program.

It has generally been desirable to employ dynamic separation enhancement in conjunction with matrix decoders. In some such systems, gain controls have been provided at the output of each decoded channel so as to emphasize or enhance the signals appearing in some (wanted) outputs at the expense of other (crosstalk) outputs. Usually, the gains are varied in response to sensing of the decoder's input or output signals to determine the direction of the dominant sound source (directional signal). This was taught in my below-referenced U.S. patents. Unfortunately, such simple "gain-riding" systems suffer from an anomaly known as "pumping", since it is clearly obvious when a channel is turned on or off. Other prior art systems use gain controls applied separately to various signal components comprising only part of the decoder output signals, so that separation may be enhanced without completely turning off (all signal components comprising) a given output. Fortunately, audible pumping effects are much less obvious in such systems. However, these systems are relatively complicated and expensive. For example, in order fully to implement such a system, the number of gain control or variable-gain elements that are required is the product of the number of primary directions to be sensed and the number of "crosstalk channels" (defined below), i.e., at last eight in a four-channel system. Further, these systems still suffer from audible shortcomings in terms of "smoothness" and freedom from audibly anomalous action. A further problem relates to the position sensing circuits required to analyse the decoder's input or output signals to determine the direction of the dominant sound source. These circuits typically are expensive and have a tendency to produce positional instabilities or effects similar to "pumping" in the reproduced program.

The most relevant prior publications are believed to be my below-referenced U.S. Patents. Other references which may be thought to be relevant are also listed:

| | |
|---|---|
| (1) My issued U.S. patents: | |
| 3,632,886 | Scheiber |
| 3,746,792 | Scheiber |
| 3,959,590 | Scheiber |
| (2) U.S. patents cited in my issued U.S. patents: | |
| 2,019,615 | Maxfield |
| 2,098,561 | Beers |
| 2,335,575 | Bierworth |
| 2,714,633 | Fine |
| 2,845,491 | Bertram |
| 3,067,287 | Percival |
| 3,067,292 | Minter |
| 3,082,381 | Morrill et al. |
| 3,126,445 | Golanske et al. |
| 3,164,676 | Brunner |
| 3,184,550 | Rogers |
| 3,280,258 | Curtis |
| 3,375,329 | Prouty |
| 3,401,237 | Takayanagi |
| (3) Other references cited in my issued U.S. patents: | |
| 1,196,711 | German patent |
| "Three-Channel Stereo Playback of Two Tracks Derived from Three Microphones" Klipsch, IRE Transactions | |
| "Circuits for Three-Channel Stereo Playback Derived from Two Sound Tracks" Klipsch, IRE Transactions | |
| (4) U.S. patents used as defendant's exhibits in litigation: | |
| 2,062,275 | Blumlein |
| 2,093,540 | Blumlein |
| 2,098,372 | Blumlein |
| 3,073,901 | Hafler |
| 3,417,203 | Hafler |
| 3,452,161 | Hafler |
| 3,697,692 | Hafler |
| 3,813,494 | Bauer |
| 3,944,735 | Willcocks |
| (5) Foreign patents used as defendant's exhibits: | |
| 361,468 | Great Britain, Blumlein |
| 362,472 | Great Britain, Blumlein |
| 363,627 | Great Britain, Blumlein |
| 394,325 | Great Britain, Blumlein |

-continued

| | |
|---|---|
| 417,718 | Great Britain, Blumlein |
| 429,022 | Great Britain, Blumlein |
| 429,054 | Great Britain, Blumlein |
| 456,444 | Great Britain, Blumlein |
| 852,285 | Great Britain, Blumlein |
| 999,765 | Great Britain, Keibs |
| 1,112,233 | Great Britain, Keibs et al. |
| 1,205,151 | Germany, Schaaf |
| (6) Journal article used as defendant's exhibit: | |
| "The 'Stereosonic' Recording and Reproducing System" Clark et al. J. Aud. Eng. Soc. April 1958 | |
| (7) Patents listed in Philips/Deutsche Grammophon 1970 "Evaluation of the Scheiber patent applications": | |
| 2,922,116 | U.S., Crosby |
| 3,184,550 | U.S., Rogers |
| 1,010,569 | Germany, Telefunken |
| 3,059,053 | U.S., Percival |
| 1,269,187 | Germany, Burkowitz et al. |
| (8) Other relevant published references: | |
| "Analysing Phase-Amplitude Matrices" Scheiber J. Aud. Eng. Soc. November, 1971 | |
| "The Subjective Performance of Various Quadraphonic Matrix Systems", Appendix BBC Research Department 1974 | |
| "4-2-4 Matrix Systems" Eargle J. Aud. Eng. Soc. December, 1972 | |

Two-to-multichannel decoders generally include (1) a matrix circuit providing localization with modest separation in accordance with principles described in above-listed "Analysing Phase-Amplitude Matrices", which is incorporated herein by reference. High-separation decoders may have, in addition to the basic matrix, (2) dynamic enhancement circuitry incorporating variable-gain elements to provide dynamic separation enhancement among the decoder's output signals (commonly, but not necessarily four) in response to sensed (time-varying) characteristics of the program material; and (3) sensing and control circuitry to provide control signals to the enhancement circuitry.

The present invention includes novel methods and circuits in all these sections (matrix, enhancement, sensing and control) which may be used all together, as in a preferred embodiment; or one or more of these novel methods and circuits may be used separately or in conjunction with other (including prior-art) circuitry. In the matrix section, means and circuits are provided for re-positioning incoming directional signals, or signals characterised by certain phase and amplitude relationships in the input channels, so as to yield improved mutual signal separation patterns as output signals. In the enhancement section, means and circuits are provided for enhancing separation further among various signals with improved economy and reduced distortion and noise. Disabling of some of the enhancement circuitry (preferably excepting that for a stereo center position) in optional combination with gain and/or frequency adjustments among outputs, yields an ambience recovery function providing both good audible separation between the rear outputs and good rejection of center information in these rear outputs. In the sensing and control section, economical means and circuits are disclosed for sensing phase-amplitude relationships or directions characterising signals in sensed channel pairs; and means for processing control voltages representing such phase-amplitude relationships and other program signal characteristics preferably to improve smoothness and freedom from error.

FIG. 1 is a polar graph of relative signal strength in a decoded output as a function of angular displacement between encoding and decoding, co-ordinates in the phase-amplitude sphere.

FIGS. 2*a–d* are symbolic illustrations of relative signal strengths at the outputs of a prior-art decoder.

FIGS. 3*a–d* are symbolic illustrations of signal strengths at the outputs of a stereo decoding matrix according to the invention.

Figure 4A:
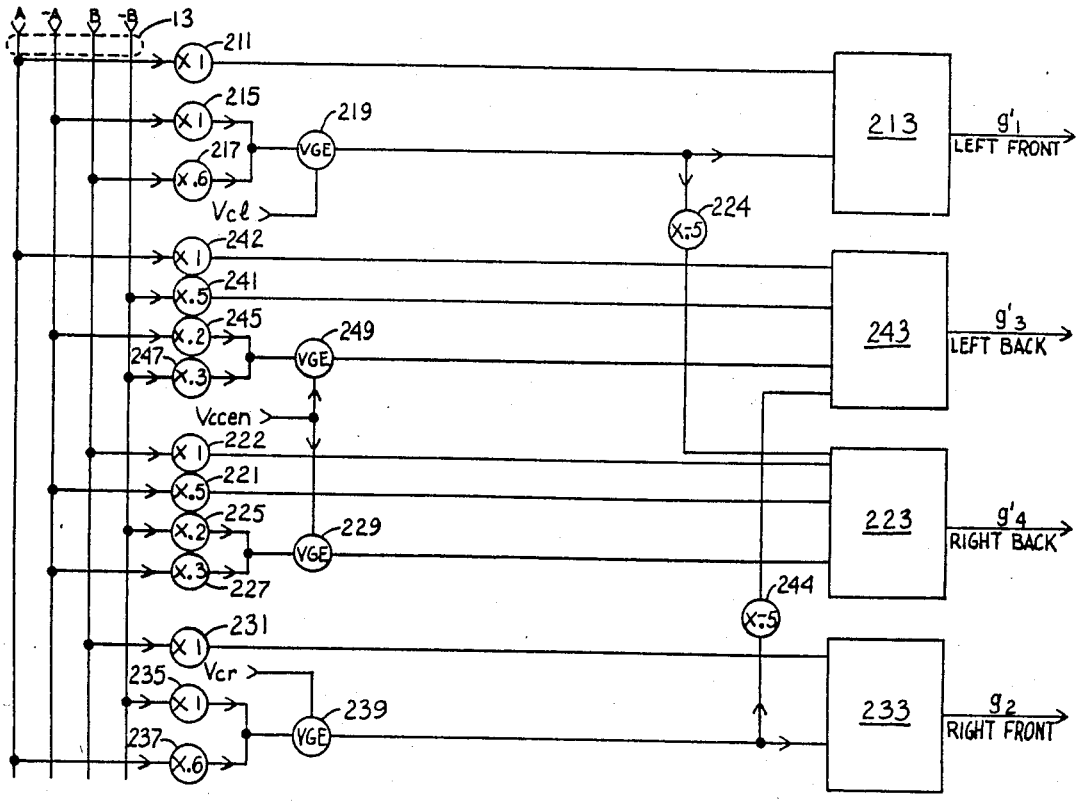

FIG. 4*a* shows a separation-enhanced decoder based on a modified stereo decoding matrix and employing four variable-gain elements according to the invention.

Figure 4B:
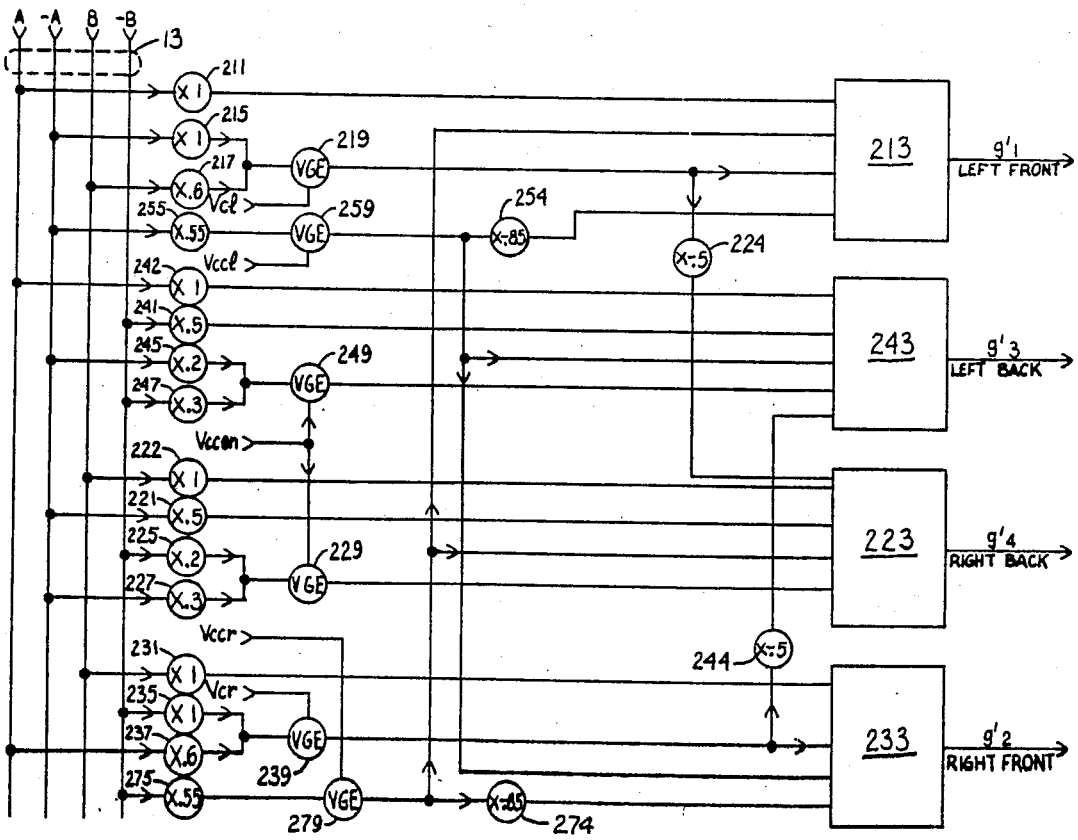

FIG. 4*b* shows an alternative separation-enhanced decoder employing six variable-gain elements according to the invention.

Figure 4C:
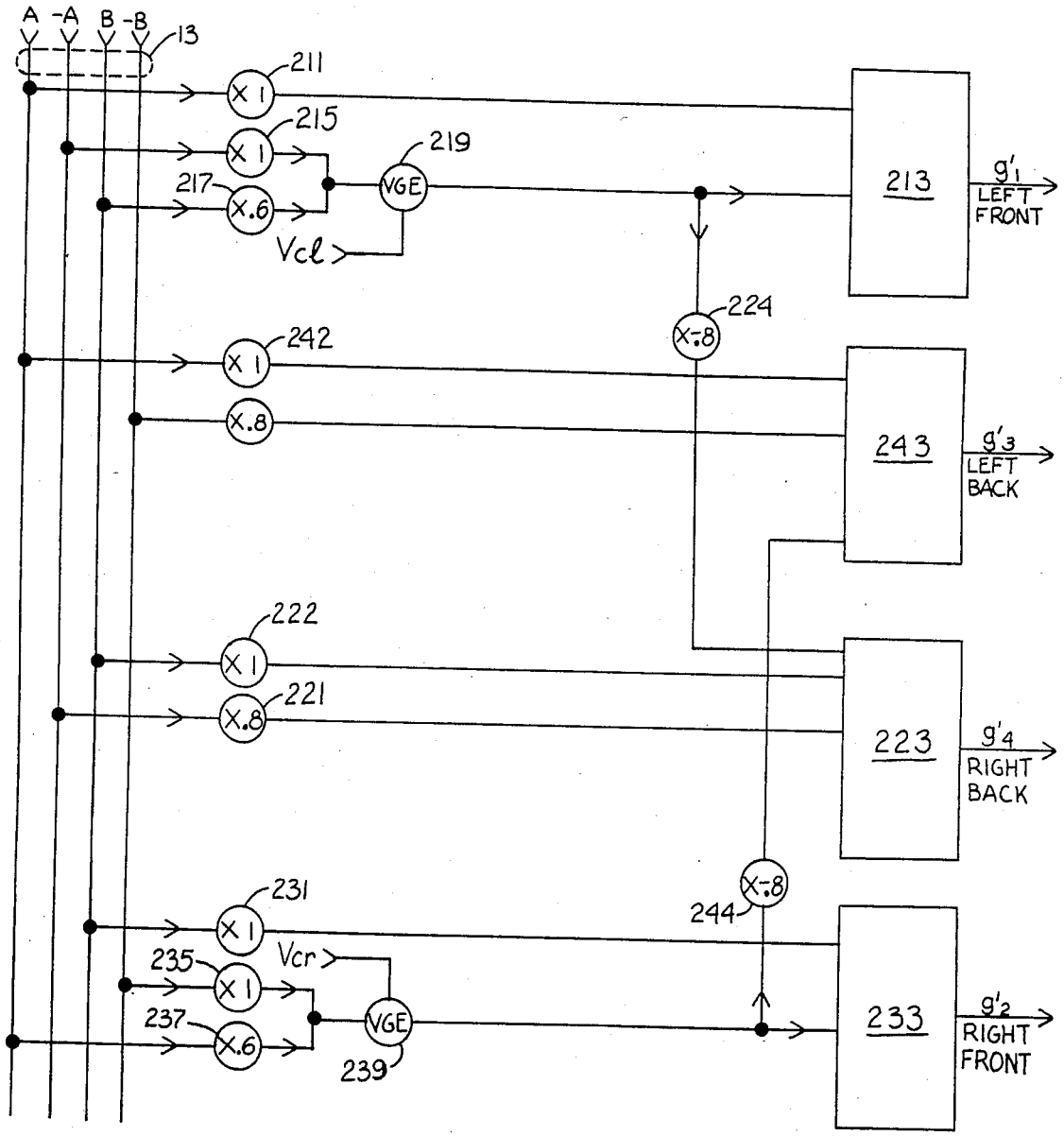

FIG. 4*c* shows a further alternative separation-enhanced decoder employing two variable-gain elements according to the invention.

Figure 5:
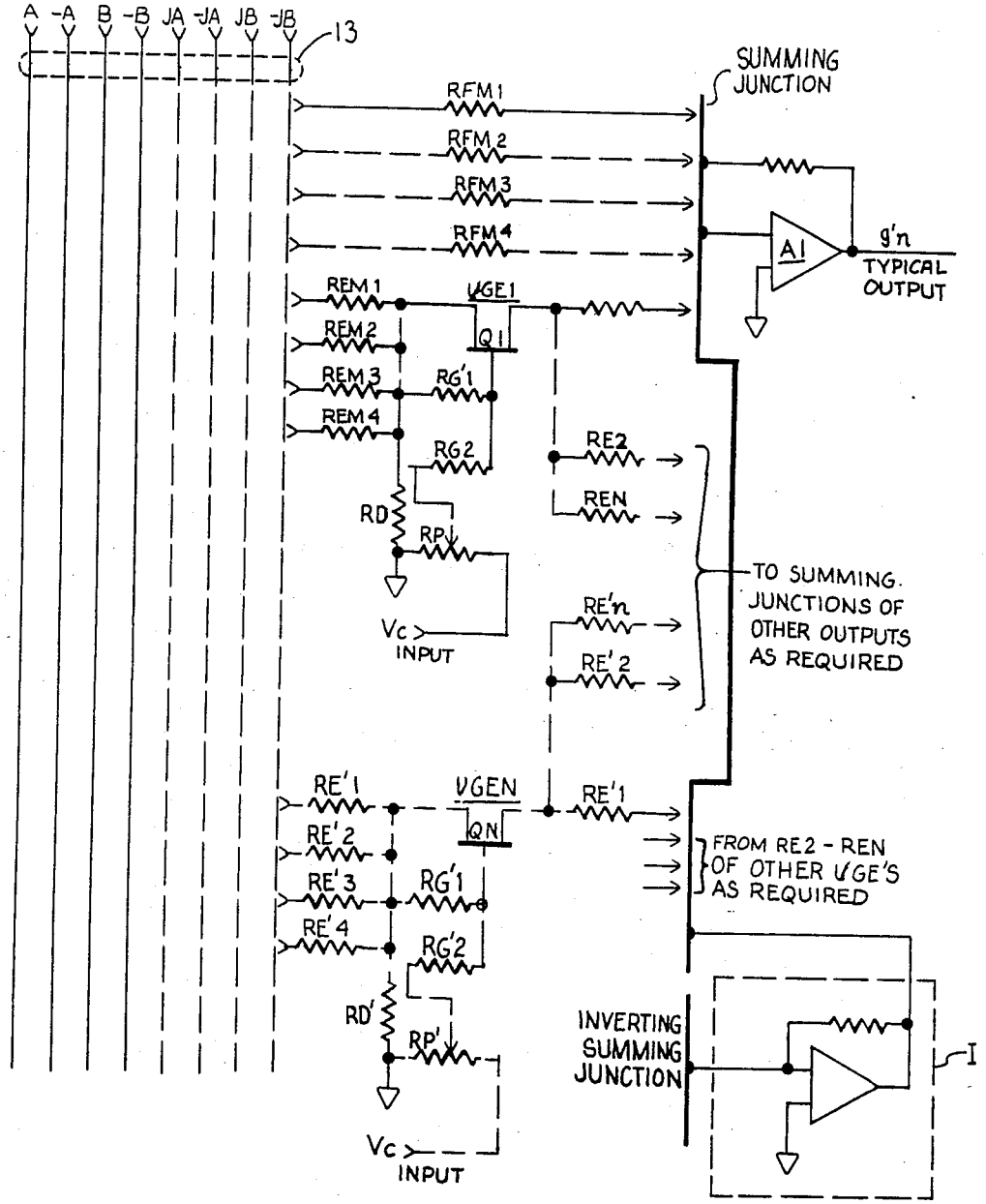

FIG. 5 shows a generalized separation-enhanced decoder for either encoded or unencoded two-channel program.

Figure 6A:
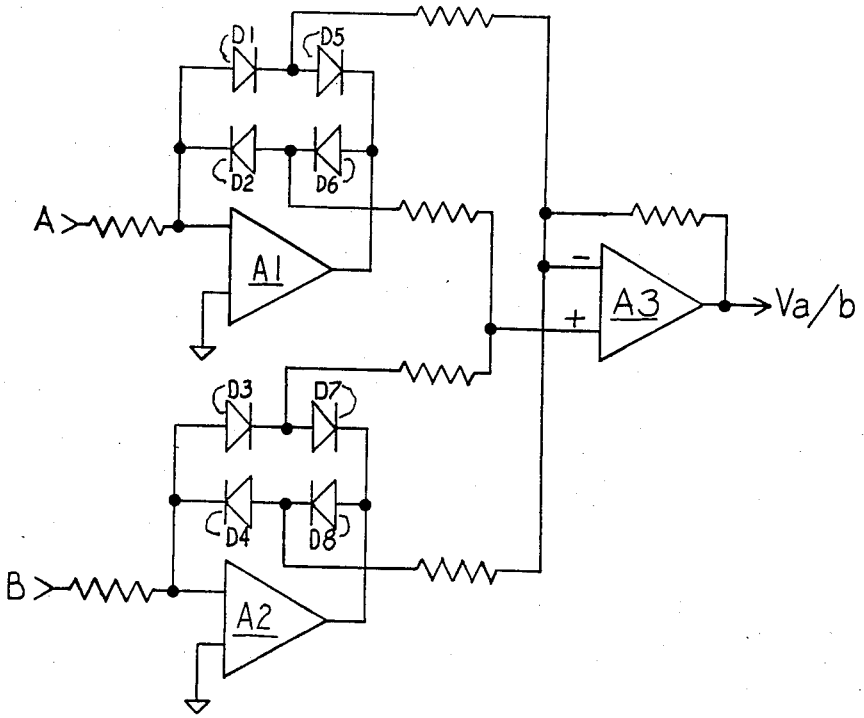

FIG. 6*a* shows a preferred-embodiment economical direction or phase-amplitude sensing circuit.

Figure 6B:
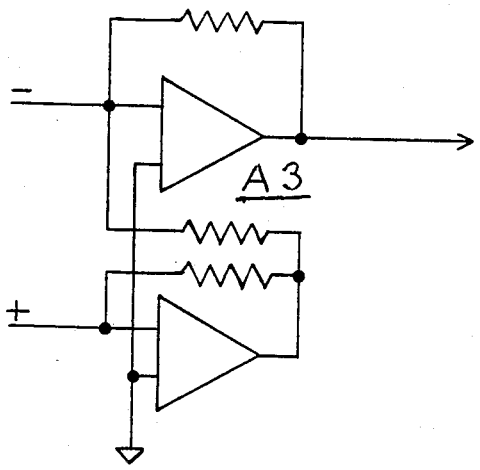

FIG. 6*b* shows an inverter for practical realization of FIG. 6*a*.

FIG. 7*a–7f* a preferred-embodiment of a complete separation-enhanced decoder including sensing of direction and other program signal characteristics, providing selectable panoramic or ambience recovery modes.

Figure 8:
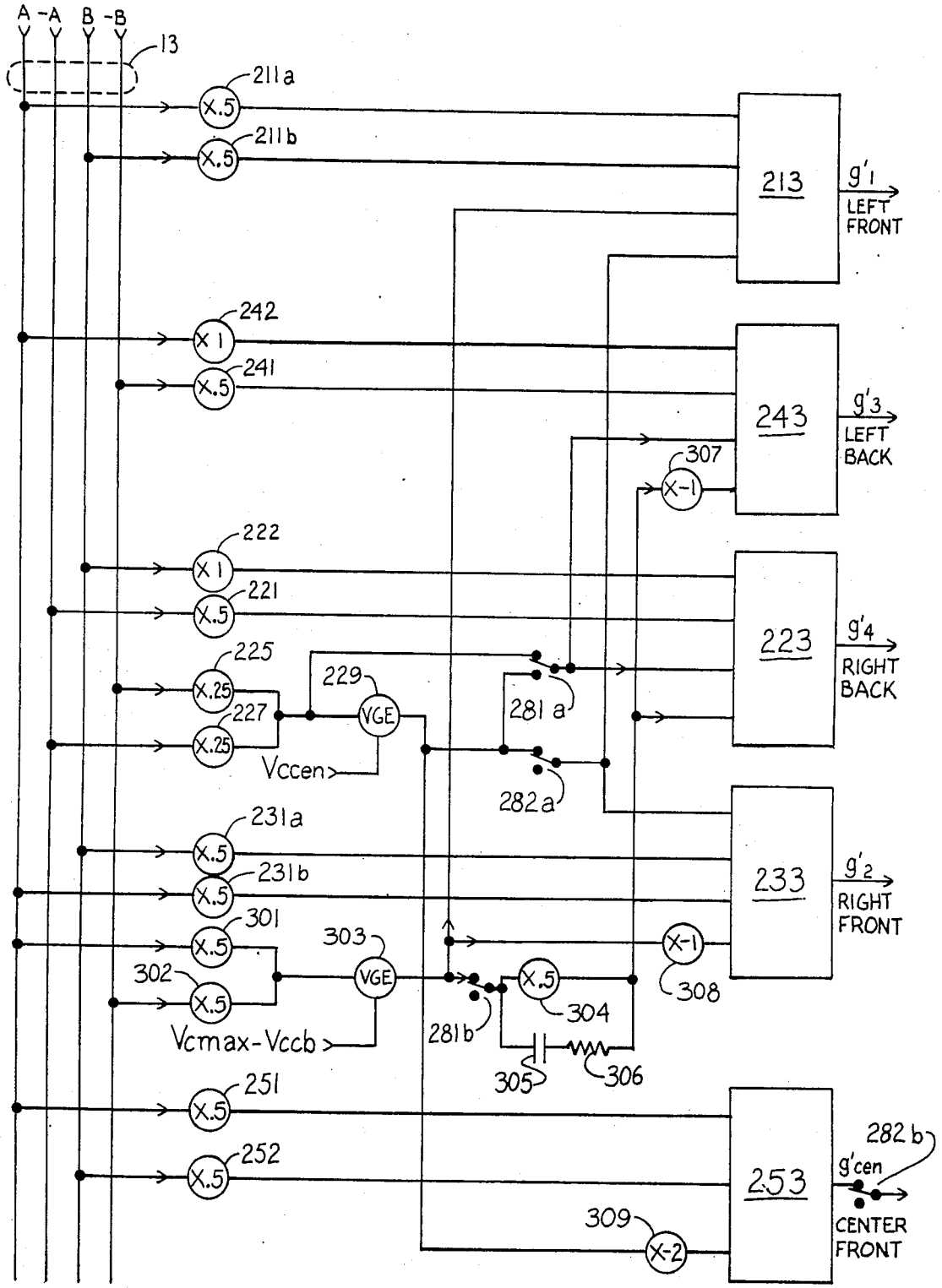

FIG. 8 shows a preferred embodiment decoder employing reverse rotation and frequency-dependent separation enhancement, and providing selectable cinema/video and panorami-c modes.

MATRIX

The above-referenced '886 and '792 patents and "Analysing Phase-Amplitude Matrices" teach that to encode a given signal at a selected spherical position (direction), the signal is applied to a pair of channels ("A" and "B") with selected amplitude ratio and phase difference. To decode at the same spherical position, the A and B channel signals are re-combined with the same amplitude ratio, but with the reverse phase difference (e.g., if encoding used a phase difference between A and B of +30 degrees, then decoding uses a phase difference of −30 degrees).

To decode at a spherical position diametrically opposite the encoded position, the A and B signals are recombined with the reverse amplitude ratio (e.g., if encoding used A=2.4B, then decoding uses B=2.4A), and with a phase difference of 180 plus the encoding phase difference in degrees (e.g., if encoding used a phase difference between A and B of 30 30 degrees, then decoding uses a phase difference of +210 degrees, also equivalent to −150 degrees).

(Since both a +180-degree and a −180-degree phase shift are equivalent to a polarity inversion, the latter may be used in place of both of the former, as in any of the embodiments hereinafter described.)

In a basic matrix decoder, i.e., a decoder comprising only the unenhanced basic matrix, each directional signal at the decoder's inputs would appear with maximum strength in any decoder output(s) having spherical phase-amplitude co-ordinates (spherical position) closest to the co-ordinates of the given input directional signal, with lesser strength in any outputs having co-ordinates further displaced from the input signal's co-ordinates (e.g., 3 dB down for a 90-degree displacement), and does not appear at all in any outputs having co-ordinates displaced by 180 degrees from (diametrically opposite) the co-ordinates of the input signal. This is in accord with the teaching of the above-referenced '886 and '792 patents; and with the equation $S_{dB}=20 \log 1/\cos 0.5$ delta theta, given in "Analysing Phase-Amplitude Matrices," where delta theta is the angular displacement between the spherical co-ordinates of the encoded directional signal and the spherical co-ordinates of the decoded output. This relationship giving relative strength of an encoded signal in a decoded output as a function of angular displacement between encoding and decoding co-ordinates is shown in FIG. 1. In FIG. 1, "S" represents attenuation in dB, the negative of relative strength in dB. It is understood that FIG. 1 illustrates a plane cross-section of what is in the general (spherical) case, a solid figure.

TABLE 1

| |
|---|
| $g_1 = .924A + .383B$ |
| $g_2 = .383A + .924B$ |
| $g_3 = .924A - .383B$ |
| $g_4 = -.383A + .924B$ |

This situation is exemplified for a four-output (four-channel) decoder by above TABLE 1, which gives the decoding equations of a preferred-embodiment decoder from the '792 patent. FIGS. 2*a* through 2*d* show relative signal strengths at the four decoder outputs for each of four different incoming encoded directional signals. These figures may be considered to represent output, or decoded separation patterns for the four given input directional signals. It is convenient, for each given input directional signal, to designate the output carrying the maximum-strength signal as the "wanted output", and the other outputs carrying components of the input signal (at −3 dB for the case of FIG. 2) as "crosstalk outputs". The decoding matrix of TABLE 1 and FIG. 2 is a "symmetrical-crosstalk matrix", since for each incoming directional signal, this signal appears with maximum strength in the wanted output, with equal, but lesser strength in the two adjacent outputs flanking the wanted output, and not at all in the diagonally-opposite output. For the listener centrally positioned with respect to four loudspeakers fed by the corresponding decoder outputs, such symmetrical disposition of crosstalk assists in correct localization of the reproduced sound source (indicated by arrow) at the wanted loudspeaker, as taught in the '886 patent.

SPHERICAL AXIS ROTATION

A desired feature of the present invention is the ability to "decode" conventional, unencoded stereophonic program i.e., to reproduce panoramically through multiple loudspeakers (typically four) program whose direct sound sources are confined to the "stereo stage" or "stereo pan path", the in-phase semicircle connecting the A and B points on the phase-amplitude sphere. It is to be noted, with regard to generalization of the invention, that while discussion is with reference to this particular "left-right" pan path connecting points A and B, operation may be transposed (rotated in the sphere) to an arc connecting any desired diametrically opposed pair of points on the sphere, i.e., the end points of any desired spherical axis (such as "front-back" points A=B, A=−B or "up-down" points A=jB, A=−jB) by feeding to the decoder's A and B inputs not the described A and B signals, but rather "C" and "D" signals which may be derived from a two-input, two-output matrix having inputs A and B, and outputs C and D such that when a directional signal in the A and B channels is at one of said desired diametrically opposed points (for example "front", i.e., A=B), the C signal is at a maximum and the D signal is at a null; while when the directional signal is at the other diametrically opposed point (for example "back", i.e., A=−B), the D signal is at a maximum and the C signal is at a null. For the exampled "front-back" case, $C=k(A+B)$ and $D=k(A-B)$. A decoder with the addition of this particular 2-in, 2-out matrix at its inputs is changed from a "left-right" to a "front-back" decoder. Two-input, two-output or "2-2" matrices are established in the electronic art, and distinct from the present applicant's patented "4-2-4" or "n-2-n" matrix art for encoding/decoding several channels or directions into/out of a pair of channels. A commercial example of "2-2" matrix is the matrix in FM receivers, the inputs of which matrix are the respective sum and difference audio signals derived from respective main carrier and subcarrier modulations, and the outputs of which are the respective left and right audio signals. The two-in, two-out matrix may be equivalently realized in practice by taking the A and B channel signals, applying variously-phased, or uninverted and inverted, versions of these A and B signals to a "multiphase bus", signal components from which bus are then combined to yield the desired C and D signals which are applied to the decoder inputs. For example, with a multiphase bus comprising A, −A, B and −B individual lines, A and B bus signal components may be combined to yield C=A+B, and A and −B components may be combined to yield D=A−B. This realization is functionally equivalent to the previously described 2-in, 2-out matrix, yielding the outputs C=maximum and D=null for the input condition A=B; and outputs D=maximum and C=null for the input condition A=−B; rotating decoder operation thereby from "left-right" to "front-back". In general, C and D may be derived by "decoding" at the spherical co-ordinates of the desired end points in accordance with the decoding equations of above-referenced "Analysing Phase-Amplitude Matrices." Spherical axis rotation applied to the signals feeding the decoder A and B inputs may as required be applied separately to a specific decoder function block, such as direction sensing, permitting a uniform direction sensing circuit to sense direction along any desired spherical axis, e. g., "left-right", "front-back" (as exampled above), "up-down", or axes of any desired orientation.

In the prior-art decoder whose relative output levels are illustrated in FIG. 2, four decoder outputs $g_1$ through $g_4$ respectively corresponding to four incoming directional signals $f_1$ through $f_4$ were evenly spaced 90 degrees apart on the phase-amplitude sphere, providing the desired symmetrical crosstalk pattern. Since four points on the stereo pan path, a semicircle, can not be evenly spaced around the sphere, "decoding" at the corresponding four points could not achieve the desired four-way symmetrical crosstalk pattern. For example, surrounding or panoramic reproduction of stereo program may be obtained by reproducing stereo left (L, or A-only) signals from a left back (LB) loudspeaker, stereo center left (CL, or A>B) signals from a left front (LF) speaker, stereo center right (CR, or A>B) signals from a right front speaker, and stereo right (R, or B-only) signals from a right back (RB) speaker. However, since signal pairs L and CL, CL and CR, CR and R are closely spaced on the pan path, while R and L are 180 degrees apart, decoding at said corresponding positions would yield a reproduced (decoded output) separation of the order of 1 dB for corresponding decoded adjacent pairs LB and LF, LF and RF, RF and RB; while adjacent pair RB and LB would have infinite mutual separation. Worse, for none of the four decoded positions would the diagonally opposite output or speaker be silent as achieved in the symmetrical-crosstalk case illustrated in FIGS. $2_a$ through $2_d$. Separation among the four outputs would thereby be grossly non-symmetrical such that the centrally-positioned listener would perceive respective stereo L, CL, CR and R sources not as localized at the desired LB, LF, RF and RB speakers, but as pulled in and forward toward a center front location by the asymmetrical crosstalk.

The following procedure for specifying the decoding matrix avoids this problem: First, we specify which input directional signals are desired to be reproduced apparently from which decoder outputs; i. e., which decoder output is to be the "wanted output", the apparent reproduced source for each incoming directional signal. For a preferred-embodiment (unencoded stereo to surround or panoramic multi-output) decoding matrix, stereo left (A only) may advantageously be reproduced apparently from a left back decoder output; stereo center left (A>B) from a left front output; stereo center right (B>A) from a right front output; stereo right (B only) from a right back output in accordance with the desired panoramic presentation of the "stereo stage".

At this point, however, we do not take the obvious course and define the left back output as having the same angular position as its corresponding input directional signal, stereo left (A only); the left front output as having the angular position of center left (A>B), etc; so that each input signal is reproduced with maximum strength from its corresponding wanted output. This was the method that resulted in the unsatisfactory crosstalk pattern discussed above, with consequent mislocalization of the reproduced directional signals other than at their respective wanted outputs. Instead, we specify the decoded output in which each directional signal is NOT to appear; i. e., the diametrically-opposite output for each input signal. Thus, incoming stereo left, intended to be reproduced from a left back location, is not to appear in a (diagonally opposite) right front output; stereo center left, intended to be reproduced from a left front location, is not to appear in a diagonally-opposite right back output; stereo center right, intended for right front reproduction, is not to appear in a left back output; stereo right, intended for right back reproduction, is not to appear in a left front output. In accordance with the above-described rule for decoding at a position diametrically opposite a given (encoded) input directional signal, the result is a decoding matrix wherein the right front output, to reject the stereo left incoming signal, contains no A component; the right back output, to reject incoming stereo center left, comprises B>−A; the left back output, to reject incoming stereo center right, comprises A>−B; the left front output, to reject incoming stereo right, contains no B component.

The result is that each incoming directional signal is rejected in the decoded output diagonally opposite the wanted output, a criterion of symmetrical-crosstalk reproduction and minimal impairment of localization by crosstalk. However, since the wanted outputs do not positionally correspond to their respective input directional signals, directional signals may not be reproduced with maximum strength in their wanted outputs, but rather in their crosstalk outputs. This is acceptable when dynamic separation enhancement is anticipated; but strength of wanted outputs relative to crosstalk outputs may optionally be adjusted by changing overall gains associated with decoded outputs, equivalent to multiplying all A and B coefficients for a given output by a constant different from a constant multiplier for other outputs. This method, permitting adjustment (strengthening) of wanted-output signals in relation to crosstalk-output signals, does not disturb the previously-defined diagonally-opposite outputs, since, as stated, these contain a signal null. This method was used to derive the stereo-decoding matrix of TABLE 2, below, such that the desired symmetrical crosstalk pattern was obtained, with each input directional signal appearing with maximum strength in its wanted output, 3 dB lower in the two adjacent (crosstalk) outputs, and not at all (signal null) in the diagonally-opposite output. In the stereo-decoding matrix of TABLE 2, as in the prior-art matrix of TABLE 1, $g_1$ designates a nominal left front output, $g_2$ a nominal right front output, $g_3$ a nominal left back output, $g_4$ a nominal right back output. Actual loudspeaker placement may vary in practice or the decoding matrix may be used for signal-separation purposes not involving loudspeaker reproduction, since output signal separation, a function of position (co-ordinates) on the phase-amplitude sphere, is electrically present independent of physical loudspeaker (and microphone) positions or directions.

TABLE 2

| |
|---|
| $g_1 = A$ |
| $g_2 = B$ |
| $g_3 = 1.41A - B$ |
| $g_4 = -A + 1.41B$ |

FIGS. $3_a$ through $3_d$ show relative signal strengths (separation patterns) for the stereo decoding matrix of TABLE 2.

It was stated above that the symmetrical crosstalk pattern assists in correct sound-source localization for the listener centrally positioned with respect to four loudspeakers fed by the corresponding decoder outputs. Based on typical practice wherein seating is generally closer to rear than to front speakers, and rear speakers are frequently more widely spaced than front speakers, it may be desired to reduce the overall gains associated with the rear outputs and/or increase the signal separation between the rear outputs. In accordance with this, a preferred embodiment modifies the rear-output positive signal coefficients from the square root of two to unity, and the negative coefficients, from unity to one-half. The resulting modified matrix is given in TABLE 3, below. TABLE 4 states this modification in more general form. In TABLE 4, $k_1$ may usually have a value of at least unity, but less than two and $k_2$ may usually have a value greater than zero, but less than that of $k_1$.

TABLE 3

| |
|---|
| $g_1 = A$ |
| $g_2 = B$ |
| $g_3 = A - 0.5B$ |
| $g_4 = -0.5A + B$ |

TABLE 4

| |
|---|
| $g_1 = A$ |

TABLE 4-continued

| |
|---|
| $g_2 = B$ |
| $g_3 = k_1A - k_2B$ |
| $g_4 = -k_2A + k_1B$ |

It will be noted that the above-described method of defining the decoding matrix outputs in terms of signal null positions diametrically opposite the desired input directional signals brings an inherent economy benefit to decoding of conventional stereo program signals: Since the stereo pan path includes only the 0-degree phase difference between A and B, the outputs defined as diametrically-opposite positions include only the 180-degree difference. Therefore, there is no requirement for costly all-pass (e. g., 90-degree) phase shifters, but only for phase inverters, acting as 180-degree phase shifters. Such all-pass phase shifters may, however, optionally be added in response to special product needs, preferably letting the above decoding matrix or its modifications described below continue to determine separation among the decoded outputs. Alternatively, phase shifters may be added at the decoder's A and B inputs, or equivalently, in the multiphase bus, so as to rotate the decoding operation as described above and in the above-referenced Eargle paper.

ENHANCEMENT

In the separation-enhanced decoder, the components of the input signal appearing in the unwanted or crosstalk outputs are dynamically suppressed in response to sensing of program characteristics including direction of the temporarily dominant input program signal or sound source. For example, in the ideal unencoded-stereo to four-channel decoder, an incoming stereo left signal would appear only in the left back output; an incoming stereo center left signal would appear only in the left front output; an incoming stereo center signal would appear equally in both front outputs, but not in the back outputs; an incoming stereo center right signal would appear only in the right front output; and a stereo right signal would appear only in the right back output.

This enhanced-separation result has previously been crudely acomplished through the use of a variable-gain element (VGE) in each of the (typically four) decoding matrix outputs, the gain associated with the wanted output being left unchanged from its basic-matrix value or optionally being boosted; while the gain associated with the crosstalk outputs may be reduced to suppress the crosstalk. This "gain-riding" method, however, tends to produce audible "pumping" effects with musical program as the different directional signals in the incoming program alternately become dominant.

A better enhancement method suppresses crosstalk not by reducing overall gain associated with the crosstalk outputs, but rather by selectively reducing gain for the components of the temporarily dominant input directional signal in the crosstalk outputs; i. e., by rotating the crosstalk outputs' co-ordinates on the phase-amplitude sphere to a point approaching diametrically opposite the sensed co-ordinates of the temporarily dominant input directional signal (see FIG. 1), thereby rejecting or suppressing the input signal in these rotated outputs. An advantage of this method over that of gain riding is that only the unwanted dominant input directional signal is rejected in the rotated crosstalk outputs. Since these outputs' overall gain (proportional to $A^2+B^2$) need not be greatly reduced to achieve crosstalk suppression, any other directional signals proper to these outputs may continue to be carried in them. In comparison with gain riding, the rotation method achieves better directional stability and less "pumping" in reproducing musical program.

Functionally approximately equivalent means for co-ordinate rotation include the following:

(1) Commutation, wherein for a given output, a VGE is placed in the signal path of the coefficient-determining elements (shown as resistors in FIGS. 4 and 5) for the basic (unenhanced or unrotated) output, and another VGE is placed in the signal path of the coefficient-determining elements for the same output in its rotated condition, both VGE's feeding the output. Rotation between the basic and the desired rotated matrix co-ordinates in the output is then accomplished by "cross-fading" or complementary gain control between the basic matrix VGE's and the rotated-matrix VGE's.

(2) Cancellation, a commercially-used means wherein the (coefficient-determining elements for the) basic (unenhanced or unrotated) matrix directly feed(s) the output without interposition of a VGE; rotation between the basic and the rotated matrix is then accomplished by feeding to the same output through a VGE a(n) "enhancement signal" or "rotation signal" comprising the negative of the basic matrix signal for the purpose of cancelling the latter, plus the desired rotated matrix signal. When the VGE is "off", the output is in its basic, unrotated or unenhanced condition; while when the VGE is "on", the output is in rotated condition. In the cancellation method, in contrast with the commutation method, the basic matrix is not gain controlled, and may therefore also be referred to as the "fixed matrix". The cancellation method is applied in a novel manner in present embodiments illustrated in FIGS. 4, 5, 7 and 8 with an improvement reducing the required number of VGE's.

(3) Reverse rotation, a novel method wherein the fixed matrix (the matrix directly feeding the output without interposition of gain control) is not the basic matrix as above, but rather the rotated matrix. Reverse rotation of the output from the rotated state to the basic matrix state may then be accomplished by feeding to the output an "anti-rotation signal" comprising the negative of the fixed (rotated) matrix signal for the purpose of cancelling the latter, plus the basic (unrotated) matrix signal. With reverse rotation, when the VGE is "off", the the output is in its rotated condition; while when the VGE is "on", the output is in its basic condition.

In the above-referenced "Analysing Phase-Amplitude Matrices", $A^2+B^2$ was always normalized to unity, providing constant total power output independent of encoding and decoding coefficients, i. e., of encoded and decoded position co-ordinates. In practical rotation, numerical coefficients for the rotated (output) signal may be chosen to yield the same power $A^2+B^2$ as the unrotated signal, or be made different as required for desired performance. Such variation in $A^2+B^2$ with rotation may be visualized as a variation in length of the radius pointing to the spherical co-ordinates of the (rotating) output signal. The case in which rotated $A^2+B^2$ approaches zero, approaches equivalence to gain-riding enhancement described above. Rotation involving variation in $A^2+B^2$ thus combines attributes of rotation and gain riding. (Of course, rotation may be applied to encoders as well as decoders, bringing somewhat analogous signal-separation benefits with alternately-dominant program directional signals.)

As practiced in a previous generation of "quadraphonic" decoders dating generally from the mid 1970's, the rotation method of separation enhancement had the disadvantage of requiring considerably more variable-gain elements (VGE's) than the gain-riding method: In simplified terms, generally the required number of VGE's was the number of crosstalk output channels multiplied by the number of sensed input-signal directions (represented in the separation-enhanced decoder by direction-sensing enhancement control voltages). This is in comparison with one VGE per output for the gain-riding method.

For example, in a stereo or 2-to-4 channel decoder employing the cancellation method of rotation for separation enhancement, an incoming stereo left dominant signal, to be heard in left back only, would require a VGE introducing a rotation signal comprising a negative A signal component together with a positive B component to the left front output, and a second VGE introducing a positive A component (at least) to the right back output; an incoming stereo center dominant signal, to be heard in both front, but neither back outputs, would require a VGE introducing negative A and B components to the left back output and a VGE introducing different negative A and B components to the right back output; an incoming stereo right signal, a "mirror-image" situation as compared with that of the incoming stereo left signal, would likewise require two VGE's. Thus, six VGE's are required to obtain crosstalk-suppressed (separation-enhanced) four-channel reproduction of three (left, center and right) incoming stereo directional signals.

(With reference to the below discussion, the terms "rotation signal" and "enhancement signal" may be used interchangeably insofar as method of separation enhancement is rotation of spherical co-ordinates.)

The present invention reduces the number of VGE's required for decoder output rotation, employing one or more of the following operations upon the ("rotation" or "enhancement") signals passed by the VGE's prior to these signals' application to the summing junctions where they are preferably combined with the basic decoding matrix outputs to achieve the VGE-controlled matrix co-ordinate rotation:

(a) phase shifting (relative to the other signals in the system) including phase inversion;
(b) frequency-response modification (relative to other signals in the system);
(c) attenuation or boosting;
(d) combination with one another.

In essence, required enhancement signals to suppress crosstalk from a given input directional signal appearing in some (unwanted or crosstalk) outputs are specified. This is done in accordance with the above rule for decoding at a spherical position diametrically opposite the encoded position. Remaining required enhancement signals (for the same input directional signal, but for other crosstalk outputs) are then specified, and it is determined (by inspection) if these remaining required enhancement signals may be obtained from (combinations of) portions of the first-specified enhancement signals, either in original or inverted (or otherwise phase-shifted) form. When convenient or in the interest of economy, said "other crosstalk outputs" may be inverted or shifted in overall phase (with respect to said "some outputs" receiving the first-specified "required enhancement signals") instead of, or in addition to, inverting or otherwise phase-shifting the (combinations of) portions of the first specified enhancement signals as discussed above. If such derivation of the remaining required enhancement signals from the first-specified ones is seen to be possible, then these remaining enhancement signals are so derived from the first-specified ones after gain control (VGE) through attenuators (resistors) and/or inverters (or phase shifters) feeding the "other crosstalk outputs" as required to yield said remaining enhancement signals. Reactive elements may supplement or replace resistors when frequency-dependent enhancement or rotation is desired (above operation b). The result is that no added VGE's are required to add said remaining enhancement signals.

In an example employing operations a, c and d, illustrated in FIG. 4*a*, the fixed matrix signal component in left front output summer 213 in accordance with TABLE 3 is A, provided through attenuator (resistor) 211 from multiphase bus 13. The fixed matrix signal components in left back output summer 243 are A−0.5B, provided through attenuators 242 and 241. The fixed matrix signal components in right back output summer 223 are B−0.5A, provided through attenuators 222 and 221. The fixed matrix signal component in right front output summer 233 is B, provided through attenuator 231.

The enhancement signal for suppressing crosstalk from an incoming stereo left directional signal (A=1, B=0) appearing in the left front output is determined to comprise −A+0.6B, provided by attenuators 215 and 217; gain for this enhancement signal is controlled by VGE 219 which is in turn controlled by enhancement control voltage Vcl. To suppress crosstalk from said stereo left appearing in the right back output, we need to remove the −0.5A signal component fed to this output by attenuator 221 of the fixed (not gain-controlled) matrix (222, 221). This may be done by adding to the right back summer 223 a +0.5A signal component. Inspection of the already-specified enhancement signal for the left front output, −A+0.6B, reveals that multiplying this by −0.5 will yield the required +0.5A signal component. Therefore, we take this already-specified enhancement signal after VGE 219, multiply it by 0.5 at 224, invert it, and apply it as the required remaining enhancement signal (for an incoming stereo left signal) to right back output summer 223. Thus, a single VGE provides two different enhancement signals: One for the left front crosstalk output, and one for the right back crosstalk output as required to rotate both outputs' co-ordinates so as to suppress crosstalk from an incoming stereo left directional signal, desired to be reproduced from a left back output (see FIG. 3*a*).

Similarly, the enhancement signal for suppressing crosstalk from an incoming stereo right directional signal (B=1, A=0) appearing in the right front output comprises −B+0.6A, provided by attenuators 235 and 237; gain for this enhancement signal is controlled by VGE 239 which is in turn controlled by enhancement control voltage Vcr. To suppress crosstalk from said stereo right appearing in the left back output, we need to remove the −0.5B signal component fed to this output by attenuator 241 of the fixed matrix (242, 241). This may be done by adding to the left back summer 243 a +0.5B signal component. Inspection of the already-specifed enhancement signal for the right front output, −B+0.6A, reveals that multiplying this by −0.5 will yield the required +0.5B signal component. Therefore, we take this already-specified enhancement signal after VGE 239, multiply it by 0.5 at 244, invert it, and apply it as the required remaining enhancement signal (for an incoming stereo right signal) to left back output summer 243. The result is an elimination of a need for a separate VGE to suppress crosstalk from an incoming stereo left directional signal appearing in the right back output, and for another separate VGE to suppress crosstalk from an incoming stereo right directional signal appearing in the left back output.

The enhancement signal for suppressing crosstalk from an incoming stereo center signal (A=B=0.7) in the left back output comprises −0.2A−0.3B provided by attenuators 245 and 247; gain for this enhancement signal is controlled by VGE 249 which is in turn controlled by Vccen. The enhancement signal for suppressing crosstalk from an incoming stereo center signal in the right back output comprises −0.2B−0.3A provided by attenuators 225 and 227; gain for this enhancement signal is controlled by VGE 229 which is controlled by Vccen. The result is a decoder requiring four, rather than the anticipated six VGE's to achieve separation-enhanced four-channel reproduction of stereo left, center and right incoming directional signals. The resulting separation-enhanced decoder, excluding enhancement for incoming stereo center left and center right signals desired to be reproduced by respective left front and right front outputs ("front-corner enhancement"), and not showing direction-sensing means (control-voltage generator), is shown schematically in FIG. 4*a*.

It is generally known that separation-enhanced decoders provide high separation for a single dominant directional signal at a given instant. In addition to accomplishing this, it is an advantage of the present preferred-embodiment matrix and enhancement (crosstalk suppression) method that simultaneous enhancement with minimal positional (directional) displacement is provided for simultaneously-occurring center front and left back or right back output signals, resulting in a subjectively "open" or "discrete" spatial quality with complex musical program.

Referring to FIG. 4*b*, in a preferred embodiment, "front-corner enhancement", i. e., reproduction of incoming stereo center left and center right signals from respective left front and right front outputs only, is provided by the addition of two more VGE's to the decoder of FIG. 4 a. As above, attenuation and inversion are employed after the VGE'S to reduce the number of VGE's below the number which would otherwise be required. In a feature of this added enhancement circuitry, the signals it provides are not the rotation signals for suppressing crosstalk from input center left and center right directional signals desired to be reproduced only from respective left front and right front outputs; but are rather partial rotation signals, which, added to the partial rotation signals resulting from the partly-up left-sensing and center-sensing control voltages Vcl and Vccen for the case of sensed incoming center left dominant directional signal; or right-sensing Vcr and center-sensing Vccen for the case of sensed center right, complete the required front-corner enhancement (suppression of crosstalk signal components appearing in decoder outputs other than the desired left front or right front).

In FIG. 4*b*, the partial enhancement signal for suppressing crosstalk from an incoming stereo center left directional signal (L=0.816, R=0.577) appearing in the left back and right front outputs is approximately −0.55A, provided by attenuator 255; gain for this partial enhancement signal is controlled by VGE 259 which is in turn controlled by enhancement control voltage Vccl. To yield the required partial enhancement signal for suppressing crosstalk from stereo center left appearing in the left front output, the enhancement signal at the output of VGE 259 is multiplied by 0.85 at 254, inverted and applied to left front summer 213.

The partial enhancement signal for suppressing crosstalk from an incoming stereo center right directional signal (R=0.816, L=0.577) appearing in the right back and left front outputs is approximately −0.55B, provided by attenuator 275; gain for this partial enhancement signal is controlled by VGE 279 which is in turn controlled by enhancement control voltage Vccr. To yield the required partial enhancement signal for suppressing crosstalk from stereo center right appearing in the right front output, the enhancement signal at the output of VGE 279 is multiplied by 0.85 at 274, inverted and applied to right front summer 233.

The result of the use of partial rotation signals as optional adjuncts to pre-existing partial rotations for intermediate directions such as the preferred-embodiment center left and center right, is that the added partial rotation circuitry (such as for front-corner enhancement) may be either added or omitted, as required by economic considerations, with little or no modification to configuration or coefficients for the existing (for example FIG. 4*a*) basic matrix or enhancement circuitry.

Referring to FIG. 4*c*, reduction in the number of required VGE's in the preferred embodiment of FIG. 4*a* from four to two, may be obtained by making the mutually antiphase A and B signal components providing the fixed (prior to summing with rotation signal) matrix for each back output more nearly equal, or equal in magnitude to suppress stereo center (to be reproduced as center front) signal components in the back outputs without introduction of gain-controlled rotation signals. For example, changing the coefficients of attenuators 241 and 221 from 0.5 as shown in FIGS. 4*a* and 4*b*, to 0.8 as shown in FIG. 4*c*, gives 14 dB suppression of the center signal in the back outputs. Note that corresponding adjustment to the attenuation coefficients in the (inverted) enhancement-signal paths at 244 and 224 is required to maintain crosstalk suppression with incoming stereo left or right directional signals (from −0.5 to −0.8 for the above 14 dB example).

Just as front-corner enhancement may be added to the decoder of FIG. 4*a* to yield that of FIG. 4*b*, it may be added to the decoder of FIG. 4*c*, with appropriate adjustments of coefficients in the front-corner enhancement circuitry, yielding a decoder of fewer VGE's than the six of the embodiment of FIG. 4*b*.

Further, in the embodiments of FIGS. 4*a* and 4*b*, the number of VGE's controlled by Vccen, and providing enhancement for an incoming stereo center directional signal, may be reduced from two to one by omitting one Vccen-controlled VGE and its associated attenuators (for example, 249, 245 and 247), substituting 0.25 coefficients in place of the shown 0.2 and 0.3 coefficients in the remaining Vccen-enhancement attenuators (e.g., 225 and 227), and feeding the gain-controlled enhancement signal from the remaining VGE (e. g., 229) to both back output summers (243 and 223).

A simple configuration incorporating basic matrix and enhancement including the above-described VGE-saving technique of modifying magnitude and phase (simple inversion for the preferred embodiments), and combining, of enhancement siganls after the VGE's, is shown for a typical (decoder) output in FIG. 5. This configuration offers advantages in cost and distortionvs.-noise performance in comparison with alternative separation-enhanced decoder configurations.

In FIG. 5, decoder input signals A and B are provided in multiphase form. The "j" signals have a 90-degree phase shift with respect to the other signals in multiphase bus 13. In the present preferred embodiments, the "j" signals used to derive other than positive and negative signals are not required. Dashed lines show signal paths used for some, but not all, basic matrices or enhancements. $Rfm_1$ through $Rfm_4$ determine signal currents, and consequently, the coefficients of the +, −, (j and −j, if any) components of the A and B signals derived from the multiphase bus and summed in the typical output $g'_n$ at the summing junction of amplifier A1 in accordance with the particular specified decoding equations (such as those of above TABLES 1 through 4). (If as is shown in FIG. 5, output summing is done using inverting amplifiers, the resulting inversion need not be taken into account since it applies uniformly to all outputs, and therefore affects neither separation nor relative phase among the outputs.) For example, if the typical output's fixed matrix terms comprise 0.2A+0.3jA-B, then $Rfm_1$ is connected to the A line of the bus and its value selected to pass a relative current of 0.2; $Rfm_2$ is connected the jA line, and its value selected to pass a relative current of 0.3; $Rfm_3$ is connected to the −B line and its value selected to pass a relative current of unity. Since this provides all the A and B component coefficients specified for $g_n$, $Rfm_4$ would not need to be used in this example. $Rfm_1$ through $Rfm_4$ comprise the coefficient-determining elements for the typical output's fixed matrix. $Rem_1$ through $Rem_4$ similarly determine the signal components comprising the enhancement or rotation signal applied to the typical variable-gain element (VGE1) comprising Q1, Rd, Rg1, Rg2, Rp. Rd reduces the level of the signal components passed by $Rem_1$ through $Rem_4$ to optimise the attenuation curve of the VGE, and also the noise/distortion tradeoff. Typically having a value of a few hundred ohms, Rd also practically shunts out components of the gate control voltage which would otherwise be passed in significant degree through Rg1 into the FET drain along with the desired signal components from the multiphase bus, resulting in control-voltage feedthrough. $Re_1$ partly determines (in combination with $Rem_1$ through $Rem_4$ and Q1's "on" resistance) the enhancement-signal current from the VGE that is applied to the typical output's summing junction (shown) or inverting summing junction, and to this end, is selected to yield the enhancement-signal coefficients in accordance with the particular specified decoding equations. $Re_2$ through $Re_n$ similarly determine enhancement-signal currents, and consequently, coefficients, applied to other output summing junctions or inverting summing junctions in accordance with the above-described operations and methods for reducing required number of VGE's. The inverter, I, of the inverting summing junction provides the phase inversion of item "a)" of the above-listed operations for reducing required number of VGE's; this phase inversion is shown as minus signs in circles in FIGS. 4*a* through 4*c*. (As previously stated, shown output summers use inverting amplifiers, but the resulting uniform inversion affects neither separation nor relative phase among the outputs, and is therefore not taken into account.) If phase shifting other than inversion is employed, a differential "psi+theta" phase shifter section may replace the illustrated inverter, and a "psi+zero" section may be interposed between (i) the Rfm and $Re_1$ signals and (ii) the summing junction. Inversion or phase shifting (shown as minus signs in FIGS. 4*a* through 4*c*) may be alternatively placed at the VGE (field effect transistor) outputs instead of at the output summing junction as shown.

VGEn comprising Qn, Rd', Rg1', Rg2', Rp' is another variable gain element for suppressing crosstalk from an additional incoming directional signal as may be required for the particular matrix/enhancement; Rem1' through Rem4' and Re1' through Ren' serve equivalent functions to their above-mentioned counterparts lacking the prime mark "'".

Illustratively, in a preferred embodiment shown in FIG. 4*b*, we consider $g'_1$, the left front output, as $g'_n$, the typical output of FIG. 5. In FIG. 4*b*, the top left circle (attenuator) inscribed "X1" is realised as $Rfm_1$ of FIG. 5; there are no $Rfm_2$ through $Rfm_4$ for the left front output. Continuing downward in FIG. 4*b*, the next circled "X1" and "X.6" are respectively realised as $Rem_1$ and $Rem_2$ of FIG. 5; there are no $Rem_3$ nor $Rem_4$. The circled "X.55" is realised as $Rem'_1$ applied to $VGE_n$ ($Q_n$). Moving rightward in FIG. 4*b*, the circled "X−0.85" is realised as $Re'_1$ fed by $VGE_n$ and applied to the inverting summing junction (instead of the shown summing junction) which provides the minus sign. The circled "X−0.5" is realised as $Re_2$ applied to the inverting summing junction of $g'_2$, the right back output. Remaining coefficient-determining and other elements of FIG. 4*b* are likewise realised in accordance with the configuration of FIG. 5. Where lines are shown in FIG. 4*b* connecting a VGE output and a summer input, without interposed circled coefficients, realisation in accordance with FIG. 5 calls for selecting any intervening components so as to preserve the coefficients as shown in the signal paths, as seen at the summed output.

Rg1 and Rg2 are equal, with a typical value of several megohms. By applying approximately half the signal voltage on the FET drain (D) to its gate (G), Rg1 and Rg2 reduce distortion in the enhancement signal passed by the FET. Rp is a potentiometer or voltage divider typically with a value of the order of a few tens of kilohms for the purpose of scaling the individual FET pinchoff voltage to the maximum value of Vc, the typical gain-control voltage. Since the FET's curve of signal passed vs. gate control voltage is very nonlinear, Vc may be previously subjected to linearity pre-correction; for example a two-segment straight-line approximation or a smooth curve generated by known means as an approximation of the inverse of the FET's curve, used with or without dead zones on the generated curve. More precise linearisation of the VGE's control characteristic may be obtained with the use of a second FET matched to the VGE FET; however, the relatively large cost increase is not offset by a significant improvement in sound with decoded musical program.

With appropriate FET's and low-noise summing amplifiers, the configuration illustrated in FIG. 5, and used in preferred embodiments, achieves good dynamic range with distortion figure of the order of 0.01%.

The preferred-embodiment FET-based VGE may be replaced with alternative variable-gain devices such as expander or noise-reduction chips, or multiplying devices of any type, including digital, with maximum gain scaled to provide the specified coefficients at the summed outputs.

This enhancement method, the configuration of FIG. 5 and the described methods for reducing required number of VGE's, may be applied to decoders having outputs at points on the phase-amplitude sphere other than those of TABLES 2 through 4, and input signals covering paths on the sphere not limited to the normal stereo pan path; in particular, decoders for program including out-of-phase encoded directional signals (signals off the stereo pan path) are contemplated.

SENSING AND CONTROL

In FIGS. 4 and 5, separation enhancement is performed in accordance with sensed direction of the dominant incoming program signal; this directional information is provided to the enhancement circuitry in the form of control voltages "Vc". The control voltages shown in FIGS. 4 and 5 are identified as follows:

| control voltage up | sensed input signal | wanted output |
|---|---|---|
| Vcl | left | left back |
| Vccl | center left | left front |
| Vccen | center | left & right front |
| Vccr | center right | right front |
| Vcr | right | right back |

Note that while the above sensed input signals are considered to extend along a left-right axis, any desired directional axis may be sensed by substitution of appropriate matrixed signals for the shown respective A and B signals at the sensing circuitry (control voltage generator; in the present preferred embodiments, a log ratio circuit) inputs, as discussed above under "Spherical Axis Rotation" and elsewhere herein.

In the disclosed preferred embodiments, Vc=0V represents "control voltage up", i.e., dominant input signal at the appropriate direction for the corresponding control voltage. Intermediate control-voltage values represent intermediate degrees of proximity of the dominant input program signal to the appropriate direction and/or degree of dominance in the total incoming program of signals having directions close to said appropriate direction.

A complete decoder sensing and control section may incorporate, in addition to sensing of dominant direction (or position on the phase-amplitude sphere) characterising incoming program signals, i. e., relative amplitude and phase between the incoming (A and B) signals, sensing of other signal characteristics. Such other characteristics include overall program level, change of program level vs. time (attack or envelope-slope sensing) and spectral distribution.

Control signals (control voltages) derived by any of the above sensing functions may be modified by application of variable time constants, variable slope, disable, "and" and "or" combinations among the sensing-derived control voltages, such as, in a preferred embodiment, "attack sense" and "level sense" comprising faster direction-sensing time constants in response to greater positive program envelope slope and overall level, with direction-sensing disable for very low overall level. The sensing section may incorporate several such functions to help achieve improved smoothness and/or relative freedom from error, anomalous action or "pumping" in the separation-enhancement process, as in preferred embodiments.

Envelope slope and level are examples of time-varying program characteristics discussed above which may be sensed and used to control signal processing functions. Other characteristics relating to program history which may be used include envelope and instantaneous waveshapes, peak-to-average ratio, spectral content. Such information currently sensed may be compared with stored information relating to program content in the interest of further performance improvement, which should become more practical as the electronic art advances; e. g., pattern recognition including more complex sequences of envelope and instantaneous waveshapes, peak-to-average ratio, spectral content such as patterns of musical pitches and rhythms; vocal, including verbal patterns; patterns of visual elements in associated video program; with such patterns optionally stored as "templates" in software or firmware.

Such functions, and above-mentioned sensing of other program characteristics bring the described advantages to a sensing and control section incorporating the novel direction-sensing (or relative amplitude/relative phase-sensing) means described herein for preferred embodiments; and are equally useable in conjunction with other, including prior-art and novel relative amplitude/relative phase-sensing means.

To derive direction-sensing voltages essentially independent of program level over a reasonably wide dynamic range, the separation-enhanced decoders of my U.S. Pat. Nos. 3,632,886, 3,746,792 and 3,959,590 used a log ratio technique. Other known direction-sensing techniques include phase comparator and automatic-gain-controlled (AGC'd) level difference.

The present embodiments attain improved economy by combining the functions of logging, program signal rectification and differencing in a simplified circuit. This economised (log A/B) sensing circuit is shown in simplified form as FIG. *6a*. In FIG. *6a*, amplifier A1 provides a negative-going log output at the cathode of diode D1 for a positive-going excursion of the A input, and a separate positive-going log output at the anode of diode D2 for a negative-going excursion; amplifier A2, D3 and D4 work analogously for the B input. D1 through D4 are the logging diodes and should be matched; a monolithic diode or diode-connected transistor array is a practical solution. Transistor arrays in "transdiode" connection may also be used. Diodes D5 through D8 are blocking or rectification diodes. Since the latter are in the feedback path, they do not introduce substantial rectification error. Amplifier A3 is a differential current-to-voltage converter; i.e., both inputs have low impedance. As an alternative to expensive instrumentation amplifiers, a practical realization of A3, using standard operational amplifiers, is shown as FIG. *6b*. Utilising the mathematical equivalence of log ratio to difference between logs, A3 performs the subtraction among the logs generated by A1, A2 and their logging diodes to yield $Va/b = \log|A|/|B|$.

As employed in a preferred embodiment for sensing of left/right stereo position (direction), the output of A3 goes maximally positive for a sensed stereo left incoming signal, maximally negative for a sensed stereo right signal, and approximately to zero for a sensed stereo center (A and B equal and in phase). Thus, the output of A3 is a bipolar voltage representing degree of stereo "leftness" or "rightness" of dominant input program signal over a wide dynamic range. This voltage, Va/b, is subsequently smoothed and speed-controlled in the process of deriving final control voltages to be applied to the enhancement section of the decoder.

Provided that the incoming program signal is on the stereo pan path or "stereo stage"; that is, provided that the A signal and the B signal are generally in phase with one another, Va/b prior to smoothing will be mainly DC with minimal ripple. When the incoming signal is not on the stereo pan path (for example, when A and B have a mutually random phase relationship observed over the Va/b smoothing time, or a phase relationship other than substantially in phase), the average magnitude and sign of Va/b over the smoothing time continue to represent degree of leftness/rightness of the incoming program signal, but Va/b contains more and more ripple as the relative phase of the A signal and the B signal diverge from mutually in phase, the ripple reaching a maximum for a phase difference of 90 degrees. Thus, over the working dynamic range of the circuit, an incoming stereo center signal yields a Va/b averaging close to zero, with minor ripple, while an incoming program with A and B signals equal, but in a random phase relationship over the smoothing time, or a phase relationship approaching 90 degrees, also yields an average voltage close to zero, but by contrast the approximately zero average is the average of a Va/b which is swinging widely positive and negative during the smoothing time. Therefore, while the average value and sign of Va/b represent proximity of the dominant incoming program signal to stereo left or stereo right (to A or B, or to whatever pair of input signals is substituted for A and B in the general case), ripple magnitude, expressed as the average of the instantaneous absolute value of Va/b, inversely represents proximity to stereo center, with magnitudes approaching zero representing greater proximity (A and B more nearly equal and in phase in the preferred embodiment), and higher magnitudes of this average of absolute value representing lesser proximity to stereo center (A and B less equal or less mutually in phase). This last characteristic is used in a present preferred embodiment to generate not only the left/right-sensing control voltages, Vcl and Vcr, derived from the processed individual positive and negative-going halves of the bipolar Va/b excursion; but also the center-sensing control voltage, Vccen, derived from the processed average of the instantaneous absolute value discussed above.

The log ratio direction-sensing technique (relative amplitude/relative phase-sensing technique) and circuit described above may be used to sense position (direction) not only on an A/B (or left/right) axis, providing control voltages representing input signal proximity to "A only", "B only" and "A=B" points on the in-phase (stereo) pan path on the phase-amplitude sphere, as described above and used in the present preferred embodiment. The circuit may be used also to sense position on any diametric axis of the sphere, as for the above-described A/B example, providing control voltages representing proximity to the ends of the selected axis and to intermediate points on an arc connecting the ends of the axis. This rotation of the direction-sensing axis may be accomplished as described above under "Spherical Axis Rotation". The "C" and "D" signals described under this heading may be described as $C = k_1A$ shifted by $theta_1$ degrees $+ k_2B$ shifted by $theta_2$ degrees; $D = k_3B$ shifted by $theta_3$ degrees $+ k_4A$ shifted by $theta_4$ degrees; with $k_1$ through $k_4$ and $theta_1$ through $theta_4$ selected to give a maximum value of C (which may be normalized to approximate unity $A^2+B^2$) with a directional signal in the incoming A and B channels having spherical co-ordinates at one end of the selected new axis or diameter), a maximum value of D (which may be likewise normalized) with the directional signal at the other end of the axis, and C approximately equal in magnitude to D at intermediate points on an arc connecting the selected axis ends.

Figure 7A:
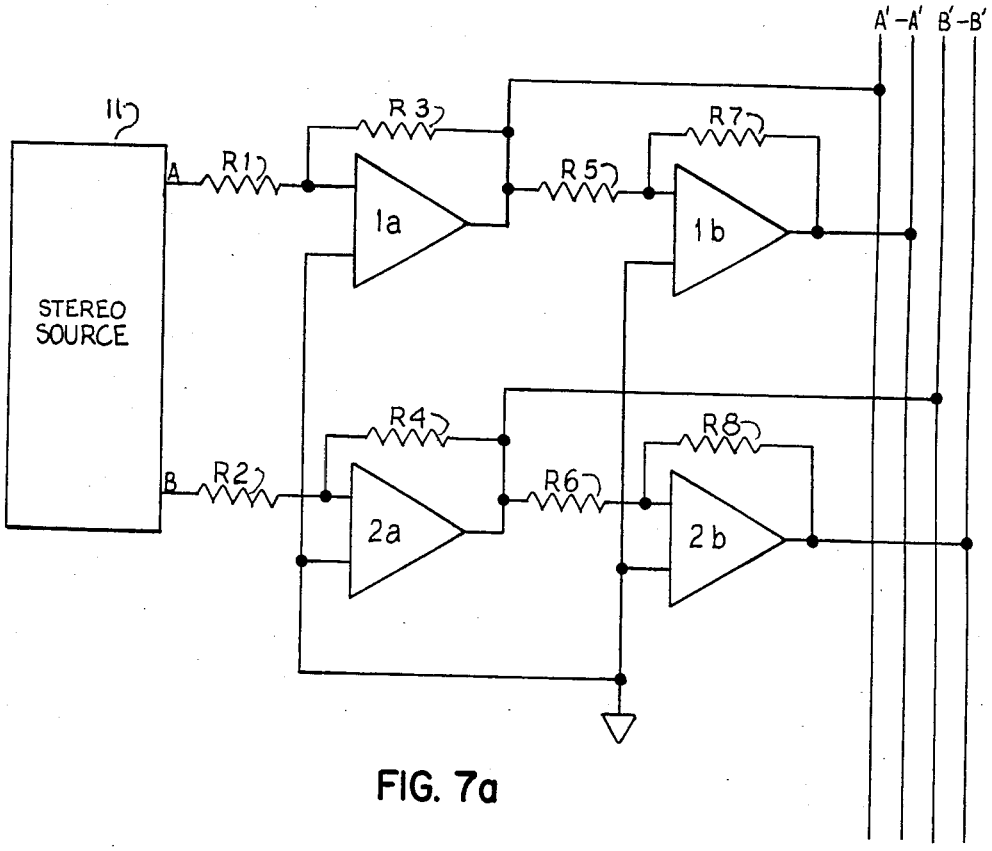

FIGS. 7*a* through 7*f* show a specific circuit diagram of an illustrated preferred embodiment of the invention, corresponding generally to the previous schematic diagrams. Referring to FIG. 7*a*, stereo source 11 provides a program contained in a pair of channels A and B, the program typically derived from audio, or audio-with-video recordings such as long-playing record, compact disc, audio or video tape, video disc or other program storage medium; or from reception of program from sources such as audio or audio-with-video broadcast or transmissions such as via electrical or optical cable. Bus drivers comprising amplifiers 1*a*, 1*b*, 2*a*, 2*b* and associated resistors R1 through R8 receive the A and B signals from stereo source 11 and provide these signals in nominally normal and reversed phases as A', −A', B', −B' to multiphase bus 13. For use with systems requiring A and B terms in other than 0-degree and 180-degree phases, the multiphase bus may additionally provide jA', −jA', jB', −jB40 or other phase-shifted A and B terms as required. As shown in FIG. 7*a*, amplifiers 1*a* and 2*a* are inverters so that A'=−A and B'=−B. As explained above for the case of the output amplifiers, this inversion is uniform for all bus driver outputs (all multiphase bus signals), and need not be taken into account, so that A' and B' may be considered as the 0-degree signals on the bus, and −A' and −B' as the 180-degree signals. Consequently, A', −A', B', −B' may be used in the apparatus in place of respective A, −A, B, −B of the matrix equations.

Figure 7C:
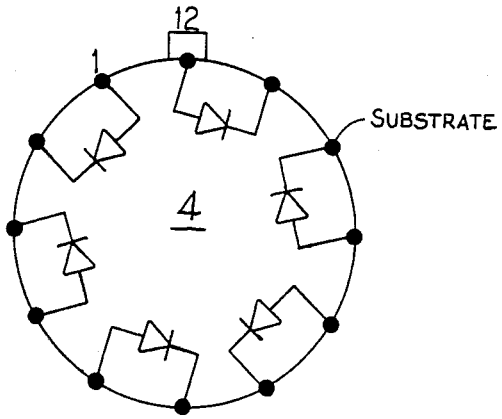
Figure 7B:
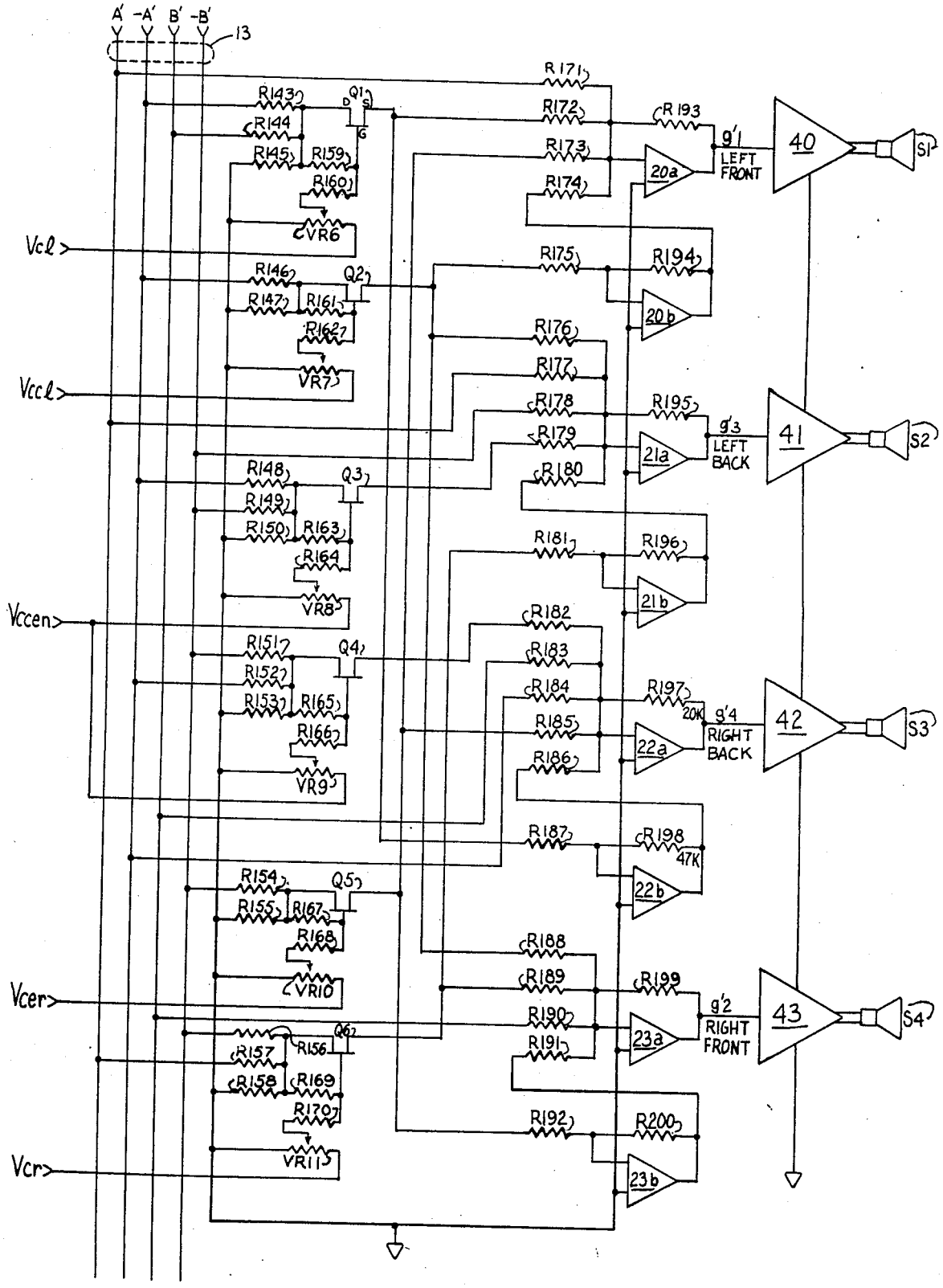

Referring to FIG. 7*b*, this is a circuit diagram for the embodiment of the general configuration of FIG. 5 shown in block form in FIG. 4*b*. As described above, the embodiment of FIG. 4*b* is derived from the embodiment of FIG. 4*a* through addition of optional "front-corner enhancement", so that separation enhancement is provided for sensed left (L; A=1, B=0), center left (Cl; A=0.816, B=0.577), center (cen; A=B=0.707), center right (Cr; A=0.577, B=0.816) and right (R; A=0, B=1) dominant directional signals of the incoming stereo program.

At the left in FIG. 7*b* a multiphase bus 13 is shown as derived in FIG. 7*a*, and also terminals T1 through T5 supplied with control voltages Vcl, Vccl, Vccen, Vccr, Vcr derived from the sensing and control section (or otherwise if desired).

Respective left front, left back, right back and right front output summers of FIG. 4*b* are amplifiers 20*a*, 21*a*, 22*a* and 23*a* in FIG. 7*b*, having respective feedback resistors R193, 195, 197, 199. The resistors from the multiphase bus directly to the output summers or inverters in FIG. 7*b* (R171, 177, 178, 183, 184, 190) provide the basic (fixed) matrix. Field-effect transistors (FET's) Q1 through Q6 and associated resistors (R145, 159, 160, 147, 161, 162, 150, 163, 164, 153, 165, 166, 155, 167, 168, 158, 169, 170) and potentiometers VR6 through VR11 provide the variable-gain elements (VGE's) of FIG. 4*b*, as discussed above with reference to FIG. 5. Amplifiers 20*b*, 21*b*, 22*b* and 23*b* provide the signal inversions shown as minus signs inscribed in circles in FIG. 4*b*; their feedback resistors (R194, 196, 198, 200) and remaining resistors in this section of the schematic (R143, 144, 146, 147, 148, 149, 151, 152, 154, 155, 156, 157, 172, 173, 174, 175, 176, 179, 180, 181, 182, 185, 186, 187, 188, 189, 191, 192) set the coefficients shown in circles in FIG. 4*b*.

To derive the fixed matrix signal $g_1$ in nominally left front output $g'_1$ resistor R171 of FIG. 7*b* corresponds to attenuator 211 of FIGS. 4*a* and 4*b*, and Rfml of FIG. 5 (with the left front output $g'_1$ taken as the typical output $g40_n$ of FIG. 5), providing the "A" fixed matrix term to the left front output summer 213 of FIG. 4*b* in accordance with the matrix equations of TABLE 3. Left front output summer 213 comprises FIG. 7*b* amplifier 20*a* and resistor R193, with summing junction located at the junction of R193 and R171–174. Note that in TABLE 3, the four outputs are designated $g_1$ through $g_4$ while in FIGS. 4, 5 and 7*b*, the respectively corresponding outputs are designated $g'_1$ through $g'_4$. This is in recognition of the fact that TABLE 3 represents the unenhanced decoding matrix outputs comprising fixed matrix only; while the outputs of FIGS. 4, 5 and 7*b* are enhanced outputs each comprising the fixed matrix signal for the particular output plus any enhancement signals applied to the output through the VGE's. Thus, the unenhanced left front output is $g_1$ and the enhanced left front output is $g'_1$; etc.

To derive the fixed matrix signal $g_3$ in nominally left back output $g'_3$ resistors R177 and R178 similarly correspond respectively to attenuators 242 and 241 of FIGS. 4*a* and 4*b*, and to Rfm1 and Rfm2 of FIG. 5 (with the left back output $g'_3$ taken as the typical output $g'_n$ of FIG. 5), and provide respective "A" and "−0.5B" fixed matrix terms to the left back output summer 243 in accordance with TABLE 3. Left back output summer 243 of FIG. 4 comprises FIG. 7*b* amplifier 21*a* and resistor R195, with summing junction at the junction of R195 and R176–180.

To derive the fixed matrix signal $g_4$ in nominally right back output $g'_4$ resistors R183 and R184 correspond respectively to attenuators 222 and 221 of FIGS. 4*a* and 4*b*, and to Rfm1 and Rfm2 of FIG. 5 (with the right back output $g'_4$ taken as the typical output $g'_n$ in FIG. 5), and provide respective "B" and "−0.5A" fixed matrix terms to the right back output summer 223 in accordance with TABLE 3. Right back output summer 223 comprises FIG. 7*b* amplifier 22*a* and resistor R197, with summing junction at the junction of R197 and R182–186.

To derive the fixed matrix signal $g_2$ in nominally right front output $g'_2$ resistor R190 corresponds to attenuator 231 of FIGS. 4*a* and 4*b*, and to Rfm1 of FIG. 5 (with the right front output $g'_2$ taken as the typical output $g'_n$ in FIG. 5), and provides the "B" fixed matrix term to right front output summer 233 in accordance with TABLE 3. Right front output summer 233 comprises FIG. 7*b* amplifier 23*a* and resistor R199, with summing junction at the junction of R199 and R188–191.

The typical variable-gain element (VGE) of FIG. 5 comprising Q1, Rd, Rg1, Rg2, Rp is exemplified in FIG. 7*b*:

- by respective Q1, R145, R159, R160, VR6 which form VGE 219 of FIGS. 4*a* and 4*b*;
- by respective Q2, R147, R161, R162, VR7 which form VGE 259 of FIG. 4*b* (VGE 259 is for front-corner enhancement in response to a sensed incoming center left signal; front-corner enhancement is not shown in FIG. 4*a*);
- by respective Q3, R150, R163, R164, VR8 which form VGE 249 of FIGS. 4*a* and 4*b*;

by respective Q4, R153, R165, R166, VR9 which form VGE 229 of FIGS. 4*a* and 4*b*;

by respective Q5, R155, R167, R168, VR10 which form VGE 279 of FIG. 4*b* (VGE 279 is for front-corner enhancement in response to a sensed incoming center right signal; as stated, front-corner enhancement is not shown in FIG. 4*a*);

by respective Q6, R158, R169, R170, VR11 which form VGE 239 in FIGS. 4*a* and 4*b*.

It will be further noted with respect to FIG. 5 depiction of the VGE's, that each output signal $g'_n$ may include more than one enhancement signal, providing enhancement for more than one sensed incoming directional signal through more than one VGE. $VGE_n$ of FIG. 5 depicts such an additional VGE. For example, taking the left front output $g'_1$ in FIG 7*b* to be the typical output $g'_n$, additional VGE's for this output are those including Q2 and Q5, since these VGE's provide enhancement signals to the left front output in addition to the VGE including Q1.

Having identified the multiphase bus, the coefficient-determining resistors for the fixed matrix, the output summers and the variable-gain elements (VGE's) in FIG. 7*b*, we now continue by identifying coefficient-determining components and signal paths for the enhancement signals, starting from the top of FIG. 7*b* with the VGE (219) which includes Q1, and working progressively down FIG. 7*b*, VGE by VGE.

To derive the enhancement signal applied to the left front output for a sensed stereo left signal in accordance with the previous discusion of such derivation, R143 and R144 in FIG. 7*b* respectively correspond to attenuators 215 and 217 of FIGS. 4*a* and 4*b*, and to Rem1 and Rem2 of FIG. 5, and provide the "−A" and "0.6B" terms of the required enhancement signal applied through VGE 219 to output summer 213 when left-sensing Vcl is up. To derive the additional enhancement signal applied to the right back output for a sensed stereo left signal also in accordance with the previous discussion, FIGS. 4*a* and 4*b* multiply the aforementioned required enhancement signal by −0.5 in inverting attenuator 224, and then apply it as the additional enhancement signal to right back output summer 223. Inverting attenuator 224 is realized in FIG. 5 as Re2 and associated inverter I; and in FIG. 7*b* as R187 and an inverter comprising amplifier 22*b* and resistors R198 and R186, with inverting summing junction located at the junction of R187 and R198.

Note with reference to the above derivation of the enhancement signal applied to the left front output that in FIG. 7*b*, R172; and in FIG. 5, corresponding $Re_1$, is interposed between VGE 219 and summer 213; however, no corresponding attenuator is shown in FIG. 4*a* or 4*b* because this enhancement signal is summed in output summmer 213 with no modification to its shown respective unity and 0.6 coefficients provided by attenuators (resistors) 215 and 217. In other words, a "X1" attenuator could have been, but was not, shown in FIGS. 4*a* and 4*b* between 219 and 213. Note that in addition to attenuators 215 and 217, $Re_1$ and all resistances within the VGE (and if used, as for the above enhancement signal for the right back output, gain of the inverter) affect the amount of enhancement signal summed in the summer. Such resistances and gains may therefore be complementarily adjusted in the interest of noise vs. distortion tradeoff, etc. The important consideration is that (when the VGE is fully on) the enhancement signal be summed with its specified coefficients relative to the fixed matrix signal in the same output. This argument applies to all enhancement signals and outputs.

To derive the "partial rotation" enhancement signal applied to the left back and right front outputs for a sensed stereo center left signal in accordance with the previous discussion of such derivation (this is "front-corner enhancement" shown in FIG. 4*b*, but not in 4*a*), R146 corresponds to attenuator 255 of FIG. 4*b*, and to Rfm1 of FIG. 5, and provides the "−0.55A" enhancement signal applied through VGE 259 to summers 243 and 233 when center-left-sensing Vccl is up. R176 and R188 interposed between 219 and respective 243 and 233, respectively corresponding to $Re_1$ and $Re_2$, do not alter the 0.55 coefficient of 255, and therefore corresponding "X1" attenuators are not shown in in FIGS. 4*a* or 4*b* in accordance with the preceding paragraph. To derive the additional partial rotation enhancement signal applied to the left front summer 213 for a sensed stereo center left signal also in accordance with the previous discussion, FIG. 4*b* multiplies the aforementioned enhancement signal by −0.85 in inverting attenuator 254, and then applies it as the additional enhancement signal to left front output summer 213. Inverting attenuator 254 is realized in FIG. 5 as $Re_n$ and associated inverter I; and in FIG. 7*b* as R175 and an inverter comprising amplifier 20*b*, R194 and R174, with inverting summing junction at the junction of R194 and R175.

To derive the enhancement signal applied to the left back output for a sensed stereo center signal in accordance with the previous discussion of such derivation, R148 and R149 in FIG. 7*b* respectively correspond to attenuators 245 and 247 of FIGS. 4*a* and 4*b*, and to Rem1 and Rem2 of FIG. 5, and provide the "−0.2A" and "−0.3B" terms of the required enhancement signal applied through VGE 249 to output summer 243 when center-sensing Vccen is up. R179 interposed between 249 and 243, corresponding to $Re_1$, does not alter the 0.2 and 0.3 coefficients of 245 and 247, and therefore a corresponding "X1" attenuator is not shown in FIGS. 4*a* or 4*b* as above. To derive the enhancement signal applied to the right back output for a sensed stereo center signal, R151 and R152 in FIG. 7*b* respectively correspond to attenuators 225 and 227 of FIGS. 4*a* and 4*b*, and to Rem1 and Rem2 of FIG. 5, and provide the "−0.2B" and "−0.3A" terms of the required enhancement signal applied throuh VGE 229 to output summer 223 when center-sensing Vccen is up. R182 interposed between 229 and 223 does not have a corresponding attenuator shown in FIGS. 4*a* or 4*b* as above. As noted in previous discussion of FIG. 4*a*, these two VGE's (249 and 229) may be consolidated into a single one by changing the 0.2 and 0.3 coefficients associated with one VGE both to 0.25 coefficients, and applying the resulting "−0.25A" and "−0.25B" terms (signal components) through the VGE to both output summers (243 and 233).

To derive the partial rotation enhancement signal applied to the left front and right back outputs for a sensed stereo center right signal (this is front-corner enhancement shown in FIG. 4*b*, but not 4*a*), R154 corresponds to attenuator 275 of FIG. 4*b*, and to Rfm1 of FIG. 5, and provides the "−0.55B" enhancement signal applied through VGE 279 to summers 213 and 223 when center-right-sensing Vccr is up. As for all the above cases, nominal "X1" attenuators are not shown in FIG. 4*b*; in this case they would correspond to R173 and R185 of FIG. 7*b*, interposed between 279 and respective 213 and 223. To derive the additional partial rotation enhancement signal applied to the right front summer 233 for a sensed stereo center right signal, FIG. 4*b* multiplies the aforementioned enhancement signal by −0.85 in inverting attenuator 274, and then applies it as the additional enhancement signal to right front output summer 233. Inverting attenuator 274 is realized in FIG. 5 as $Re_n$ and associated inverter I; and in FIG. 7*b* as R192 and an inverter comprising amplifier 23*b*, R200 and R191, with inverting summing junction at the junction of R200 and R192.

To derive the enhancement signal applied to the right front output for a sensed stereo right signal, R156 and R157 in FIG. 7*b* respectively correspond to attenuators 235 and 237 of FIGS. 4*a* and 4*b*, and to Rem1 and Rem2 of FIG. 5, and provide the "−B" and "0.6A" terms of the enhancement signal applied through VGE 239 to output summer 233 when right-sensing Vcr is up. To derive the additional enhancement signal applied to the left back output for a sensed stereo right signal, FIGS. 4*a* and 4*b* multiply the aforementioned enhancement signal by −0.5 in inverting attenuator 244, and then apply it as the additional enhancement signal to left back output summer 243. Inverting attenuator 244 is realized in FIG. 5 as $Re_2$ and associated inverter I; and in FIG. 7*b* as R181 and an inverter comprising amplifier 21*b*, R196 and R180, with inverting summing junction at the junction of R196 and R181.

Resulting enhanced decoded outputs $g'_1$, $g'_3$, $g'_4$ and $g'_2$ may be applied to power amplifiers 40, 41, 42 and 43, which in turn may drive loudspeakers 51, 52, 53 and 54 as shown in FIG. 7*b*.

Directional or positional designations such as "right front output" used in the above description are nominal, since separation-enhanced decoding does not depend on actual physical positions, but rather on phase and amplitude relationships among electrical signals.

Figure 7D:
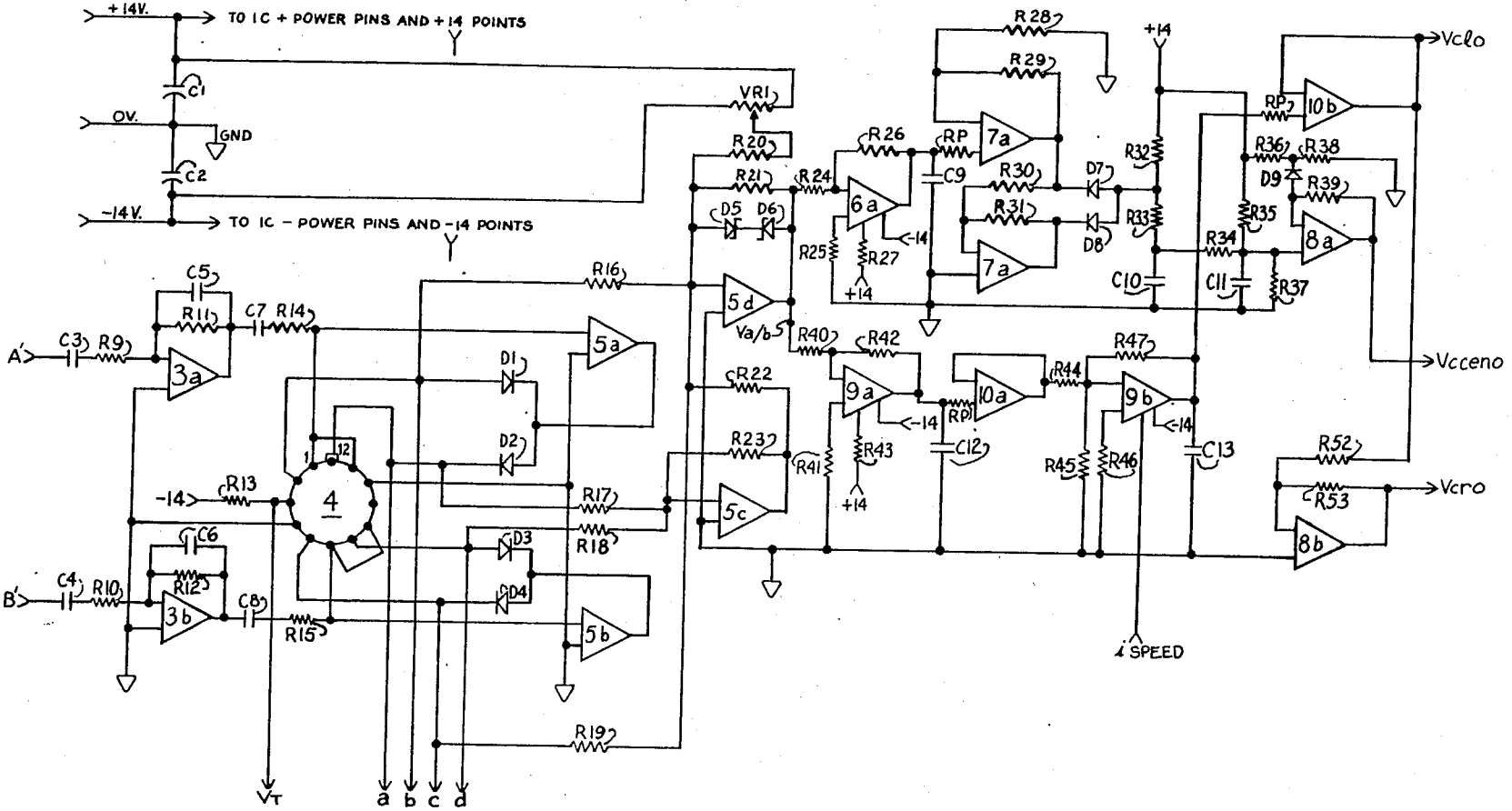

Referring to FIG. 7*c*, this shows internal connections for a monolithic array of diodes D91 through D96 used as integrated circuit 4 in FIG. 7*d*.

Referring to FIG. 7*d*, C1 and C2 are on-board power supply decoupling capacitors for the bipolar supply which provides power (+/−14 V) and reference voltages to the circuitry of FIGS. 7*a* through 7*f*.

Log drivers comprising amplifiers 3*a* and 3*b*, capacitors C3 through C8 and resistors R9 through R15 provide frequency-weighted drive to the direction-sensing circuitry (here using log rato method) and other program-sensing functions including level sense and attack sense. Frequency weighting includes preferred weighting of important frequencies, with both low and high rolloffs. The result is this: The basic direction sensing circuitry (log |A|/|B| in the present embodiment) generates a direction-sensing voltage (left/center/right-sensing Va/b in the present embodiment) proportional to the dB unbalance between the (A and B) input signals. This voltage, in the present left/center/right embodiment, represents degree of "leftness" or "rightness" of the incoming two-channel signal, and is unaffected by signal frequency as long as there is a single frequency applied to the inputs and the signal is within the sensing dynamic range. However, if the incoming program signal simultaneously contains more than a single frequency, the direction sensing will be "more interested" in program frequencies closer to the peak of the frequency-weighting curve than in frequencies displaced from the peak.

The log ratio circuit comprising diode array integrated circuit 4, amplifiers 5*a* through 5*d*, diodes D1 through D6, resistors R16 through R23 and potentiomenter VR1 generates left/right sensing voltage Va/b representing leftness/rightness information for the incoming two-channel (A and B) program. Using four diodes of six-diode monolithic array 4, amplifiers 5*a* and 5*b* provide separate logs for the plus and minus halves of the (frequency-weighted) A′ and B′ signals, the resulting four logs then being applied through R16, R17, R18 and R19 to amplifiers 5*c* and 5*d*, which take the difference between the appropriate logs to yield the instantaneous log ratio, log A/B=log A+ −log B+ −log A− +log B−. (In the present description, "+log A′+" means the positive-going log of the positive swing of the A′ signal, and so forth. The prime mark ′ designates an output of the bus drivers shown in FIG. 7*a*.)

This is obtained as follows: A positive-going current swing of the (inverted and frequency-weighted) negative-going A′ signal applied through R14 to amplifier 5*a*'s summing junction causes 5*a* to apply an equal but opposite (negative-going) current, through blocking diode D1 and a first logging diode of monolithic array 4, to 5*a*'s summing junction. A voltage proportional to the log of this current, −log A′−, appears at the junction of this first logging diode and blocking diode D1, and this log is applied through R16 to differencing amplifier 5*d*. Producing a signal proportional to the log of an input signal by means of a diode in an operational amplifier feedback loop is a conventional technique in analog computer design.

A positive-going swing of the negative-going B′ signal applied through R15 to amplifier 5*b*'s summing junction causes 5*b* to apply an opposite (negative-going) current through blocking diode D3 and a second logging diode of array 4 to 5*b*'s summing junction. The log voltage, −log B′−, appears at the junction of the second logging diode and blocking diode D3, and this log is applied through R18 to an inverter comprising amplifier 5*c* and R23, which applies the resulting +log B′− through R22 to differencing amplifier 5*d*.

Similarly, a negative-going swing of positive-going A′ applied through R14 to amplifier 5*a*'s summing junction causes 5*a* to apply a positive-going current through blocking diode D2 and a third logging diode of the array, and the log voltage at the junction of these diodes is applied through R17 to inverting amplifier 5*c* which applies resulting −log A′+ to differencing amplifier 5*d*.

A negative-going swing of positive-going B′ applied through R15 to amplifier 5*b* similarly results in appearance of +log B′+ at the junction of a fourth logging diode of the array and D4, and this log is applied through R19 to 5*d*.

The result is that the output of 5*d*, which is in inverting mode, is proportional to log A′− −log B′− +log A′+ −log B′+. Since A′=−A and B′=−B (see note above), we have log A+ −log B+ +log A− −log B−, or log |A|/|B|.

Transistors in diode or transdiode connection may be substituted for the diodes of array 4; alternative configurations for a functionally similar result would include first separately rectifying the A′ and B′ signals, separately logging the resulting rectified signals, and then differencing the resulting logs.

Alternative direction-sensing methods other than log ratio include differencing AGC'd (automatically gain-controlled) averaged or instantaneous A′ and B′ signals; amplitude-to-phase, 2-in-2-out matrix translating input amplitude difference to output phase difference followed by phase comparators; division of A by B (or vice-versa), depending on required "A-sensing" or "B-sensing" voltage. Direction sensing may employ analog circuits or digital circuits, or both. These alternatives apply to the sensing of relative amplitude of the pair of signals (A and B). As previously noted, sensing of direction (position) on other spherical axes (which may for example include sensing of relative phase A=jB/B=jA instead of A/B) may be accomplished by adding a 2-in-2-out matrix, or equivalent matrix driven by a multiphase bus, at the inputs of the illustrated, inherently relative-amplitude-sensing log ratio circuit; the same applies to the AGC method, since this is also an inherently relative-amplitude-sensing method. Conversely, inherently phase-sensing methods such as phase comparator could obviously omit the 2-in-2-out matrix translating amplitude difference to phase difference when phase difference is the required sensed informaion. These or other methods of sensing relative amplitude and/or relative phase for a pair or signals may be performed by either analog or digital means which the interest of economy may dictate. A limiting case of economising direction sensing could simply difference the instantaneous or average A′ and B′ signals (or outputs of the 2-in-2-out matrix or equivalent, when relative phase is to be sensed), resulting in limited dynamic range for the direction sensing.

Potentiomenter VR1 is a zero adjustment for the condition of equal A and B (or A′ and B′) amplitudes in the illustrated embodiment (or the condition of no phase difference, in embodiments adapted through addition of a 2-in-2-out matrix or equivalent for translating phase difference into amplitude difference at the A′ and B′ inputs of FIG. 7*d*). In the present relative-amplitude-sensing embodiment, left/right sensing voltage Va/b out of differencing amplifier 5*d* goes positive with increasing "leftness" and negative with increasing "rightness".

Among basic direction-sensing methods, log ratio has the following characteristics:

(a) Circuit economy;

(b) No all-pass phase shifters required for drive;

(c) Minimum ripple frequency is double the frequency of the sensed incoming signals, with a preponderance of higher-order harmonics due to nonlinearity of the log curve, improving response speed and reducing ripple-filter requirements. The log ratio direction-sensing voltage contains no ripple (with the exception of zero-crossing glitches) when the sensed incoming signal pair (A and B or A′ and B′ for relative-amplitude or left/right sensing) are mutually in phase (on the stereo pan path or "stereo stage") for left/right sensing;

(d) Voltage-vs.-direction-sensed curve turns up as it leaves the origin, which can conveniently be scaled to provide linearity pre-correction for the downward-turning gain-control curve of a series-connected FET (field-effect transistor) variable-gain element (VGE). This eliminates the need for additional linearity-correction circuitry which would be advisable if a basic direction-sensing method other than log ratio, such as AGC or phase comparator, were used in conjunction with FET VGE's. This will be seen below, where a "full-up" direction-sensing voltage (representing for example maximal leftness, rightness, etc., of the incoming sensed program signal) is approximately 10 volts; while the "halfway-up" voltage representing an intermediate sensed direction (position) is not approximately 5 volts as might be expected; but rather approximately 3 volts. Note that we are discussing control linearity for the VGE. Another method, involving application of approximately one-half the drain signal voltage to the gate of the FET employing resistors Rg1 and Rg2, for the purpose of improving audio signal linearity (reducing distortion), is employed in the detailed VGE circuit of FIG. 7*b*.

As an economy note, the use of a differencing amplifier (5*d*) having low-impedance summing junctions for both inverting and non-inverting inputs would make the use of inverting amplifier 5*c* unneccessary. For example, current-mirror-input amplifiers provide an approximation of such an amplifier.

Zero-crossing-error ("glitch") suppression comprising amplifiers 9*a* and 10*a* and resistors R40 through R43 and Rp, and C12, suppresses errors in the log ratio mainly attributable to logging amplifier (5*a* and 5*b*) gain-bandwidth product limitations, affecting low-level high-frequency signals, which error defines the lower limit of the direction-sensing dynamic range. Error suppression here uses transconductance amplifier 9*a* as a symmetrical (plus-and-minus-going) current limiter for the direction-sensing voltage out of 5*d;* the current-limited direction-sensing voltage is then applied to C12, resulting in limited charging/discharging rate for this capacitor, equivalent to limited slew rate. Resistor R43 sets the current into 9*a*'s biasing terminal, and consequently, in conjunction with the value of C12, sets the slewing limit. Follower 10*a* reads the rate-limited direction-sensing voltage appearing across C12. Amplifier 9*a* also applies gain and polarity inversion to the direction-sensing voltage, and the direction-sensing voltage is advantageously observed at the output of 10*a,* where it has a scaling of at least −10 volts for a full left sensed position (direction); +10 volts for full right; zero when the incoming directional signal is neither left heavy nor right heavy; approximately −3 volts for a center left signal; approximately +3 volts for center right.

Variable-speed response of the left/right sensing Va/b, or more properly, variable slewing-rate limit, is provided by transconductance amplifier 9*b,* follower 10*b,* R44 through R46, Rp, C13. This is done as follows: With 9*b* connected in inverting feedback mode, gain of this stage seen by the direction-sensing voltage out of 10*a* is generally set by the (negative of the) resistance ratio of R47/R44; while the stage's positive and negative current output limit is set by the current fed to 9*b*'s biasing terminal by speed-control circuitry such as that described below. This symmetrical (+and −) current limit translates into a variable, linear charging/discharging rate for C13, resulting in a variable response speed (slewing limit) for the direction-sensing voltage as read by follower 10*b;* speed is varied by varying the current, $i_{speed}$, fed into 9*b*'s biasing terminal.

More economical transconductance devices than the CA3280 used as 9*a* and 9*b,* such as the CA3080, are useable, as are variable-resistance devices including FET's, or electrically-variable low-pass filters, switched-capacitor devices, multipliers, etc., suitable to implement the variable-speed function.

As shown in FIG. 7*d,* when speed is reduced to approach a minimum limit, (inverting) gain of the stage including 9*b* decreases below the value set by R47/R44. If this effect is not desired, stage feedback can be taken from the output of follower 10*b* rather than as shown, from the output of 9*b*.

As shown here, quiescent speed at nominal reference input level to the total decoder (A and B inputs in FIG. 7*a*) of approximately −10 dBv or 250 mV, with neither attacks nor decays sensed by the below-described speed-control section (FIG. 7*e*), is about 500 volts/-second; attacks (rising program envelope slopes) can increase this speed up to a maximum of about 5000 volts/second; decays or program levels close to control-voltage disable threshold (also provided in FIG. 7*e*) can decrease speed down to a minimum of about 50 volts/second (remember that direction-sensing voltage Va/b varies through +/− approximately 10 volts). Even close to the disable threshold, with speed approaching its minimum of about 50 volts/second, a sufficiently strong attack can make speed approach or reach its maximum of 5000 volts/second. As illustrated, the stage including 9*b* applies a gain of −1.1 to the direction-sensing voltage, excepting close to the minimum speed limit as noted above.

The positive swing at the output of 10*b* becomes Vclo, the control voltage controlling crosstalk suppression for an incoming A-only or stereo left signal which the preferred-embodiment decoder reproduces as left back or $g'_3$. Vclo is at least +10 volts for a stereo left incoming signal, approximately zero volts or lower for a stereo center or right, and about 3 volts for stereo center left (intermediate between left and center). The "o" suffix of Vclo, as for further direction-sensing control voltages "Vcxo" discussed below, simply refers to the fact that in the embodiment of FIG. 7, o-suffixed control voltages are to undergo further processing (in FIG. 7*e*) before application to the variable-gain elements (VGE's) of FIG. 7*b*.

An inverter comprising amplifier 8*b* and resistors R52 and R53 inverts the voltage out of 10*b*, making the negative swing out of 10*b*, representing "rightness", appear as a positive swing, which becomes Vcro, the control voltage controlling crosstalk suppression for an incoming B-only or stereo right signal, which the prefered embodiment decoder reproduces as right back or $g'_4$. Vcro is at least +10 volts for a stereo right incoming signal, zero volts or lower for stereo center or stereo left, and about 3 volts for stereo center right. Control-voltage inverters such as that of 8*b* would not be required if the variable-gain elements (FIGS. 5, 7*b*) included p-channel, in addition to the present embodiment's n-channel FET's, since the p-channel devices could directly use the negative-going control-voltage swings.

Amplifiers 6*a*, 7*a*, 7*b*, 8*a*, diodes D7, D8 and D9, resistors R24 through R39, and capacitors C9 through C11 derive a center-sensing control voltage Vcceno from the left/right-sensing Va/b appearing at the output of 5*d*. Recall that this latter voltage goes to zero when A and B incoming levels are equal. This is the case regardless of whether A and B are in phase, representing a stereo center directional signal, crosstalk from which is to be suppressed in the back decoder outputs; or whether A and B are equal, but in a random-phase relationship representing diffuse or multiple directional signals (sound sources), in which case we want to leave the basic matrix alone and not enhance separation for a particular direction. Therefore, we want to have a center control voltage which comes up for equal, in-phase A and B; but not for equal, random-phase A and B. (As noted in the discussion relating to FIG. 4*c*, a simpler decoder may be made with no center-activated separation enhancement.) The present Vcceno generator makes use of the fact that left/right-sensing Va/b averages zero when A and B are equal in level regardless of their relative phases; but contains wide ripple when A and B have a random phase relationship; and contains no ripple (or only zero-crossing glitches) when A and B are in phase, representing for example a stereo center signal.

In deriving Vcceno, transconductance amplifier 6*a* with resistors R24 through R27 and capacitor C9 is a zero-crossing-error suppressor similar to the circuit including transconductance amplifier 9*a* described above. Amplifiers 7*a* and 7*b* with diodes D7 and D8, resistors Rp and R28 through R31 and capacitors C10 and C11 full-wave rectify Va/b about its center (zero volts) and smooth the rectified signal with attack time set by R33 and C10, and decay time by R34, R35, R37 and C11. This smoothed voltage, representing ripple magnitude, is subtracted from a positive reference, scaled and corrected in linearity by the circuit comprising amplifier 8*a*, diode D9 and resistors R32 through R39 so as to go approximately to +10 volts when A and B are equal and in phase; to zero volts or lower for A only, B only and for randomly-phase-related A and B regardless of relative levels; and to about 3 volts for A and B unbalances corresponding to stereo center left or center right incoming signals. (Regarding the 3 volts, note the above comments regarding FET control nonlinearity in the above discussion of the characteristics of the log ratio direction-sensing method, and regarding center left and center right sensed directions with reference to Va/b.) The resulting voltage at the output of amplifier 8*a* becomes Vcceno, the control voltage controlling crosstalk suppression for an incoming stereo center signal which the decoder reproduces as center front from outputs $g_1$ and $g_2$.

In the entire preceding discussion, Rp is a resistor used to prevent amplifier output polarity reversal with excessive negative input swing when susceptible FET-input amplifiers are used. Rp would be omitted at the input of optionally-useable bipolar-input amplifiers. The above-described Vcceno generator is able to derive a satisfactory sensing of center as a "by-product" of left/-right (A/B) direction sensing. However, when for example a "front/back" dimension must be sensed to distinguish between approximately zero-degree and approximately 180-degree relative phase of A and B, then this Vccen generator may be advantageously replaced by "front/back" direction sensing circuitry analogous in its dimension (on its spherical axis) to the "left/right" direction sensing described above. In the above discussion of log ratio direction sensing with reference to FIG. 7*d*, sensing of a "left/right" (A/B) dimension was illustrated. In other words, the two inputs to the direction-sensing circuitry were A′ and B′, the end points of a "left/right" axis on the phase-amplitude sphere. Analogous sensing of other dimensions (in the phase-amplitude sphere) may be obtained by substituting for the given A′ and B′ (or A and B), signals corresponding to the end points of the desired sensing axis, which, in accordance with previous discussion, may be obtained for example by means of a 2-in, 2-out matrix or equivalent. For example, to sense a "front-back" (A=B-/A=−B) dimension, we may substitute respective A+B and A−B for A and B (or A′ and B′) feeding the direction-sensing circuitry. Similarly, to sense an "up/- down" dimension, A+jB and A−jB may be substituted for A and B; and so on.

The need to sense at least two dimensions (e. g., left/-right and front/back) for decoding surround-encoded program material makes more economically interesting an alternative log ratio configuration. Note that the log ratio circuit deriving Va/b as shown in FIG. 7*d* effectively "telescopes" together the functions of logging, rectification and differencing of the log voltages. An alternative is to (precision-) rectify (and smooth) the frequency-weighted A and B separately, log each resulting absolute value separately, and then difference the two logs to get the log ratio. While this requires added amplifiers for the precision rectifiers (if used), it requires the taking of only two individual logs per direction-sensing circuit (per dimension) rather than four as in the present circuit, so that a single log diode array (containing at least four matched diodes) could be shared by both (e. g., "left/right" and "front/back") dimensions of sensing. In the log ratio configuration illustrated in FIG. 7*d*, the loggers must be fast enough to log the instantaneous value of the incoming (audio) signal; while with the alternative configuration, only the smoothed envelope of the incoming signal must be logged, reducing speed requirements for the log circuitry. Consequently, amplifier gain-bandwidth limitations in such an alternative configuration would mainly affect the performance of the precision rectifiers rather than the loggers as in the FIG. 7*d* log ratio circuit, and some extension of the low end of the sensing dynamic range should result. However, amplifiers of higher gain-bandwidth product than the approximately 4 MHz of available "bifet" types would improve sensing dynamic range for either configuration. Partial forward biasing of the blocking diodes (and/or logging diodes) in the present illustrated configuration, or of the rectifying diodes in the alternative configuration, would narrow the no-feedback region around zero crossing for the log (or rectifier) amplifiers, reducing gain-bandwidth requirements.

Figure 7E:
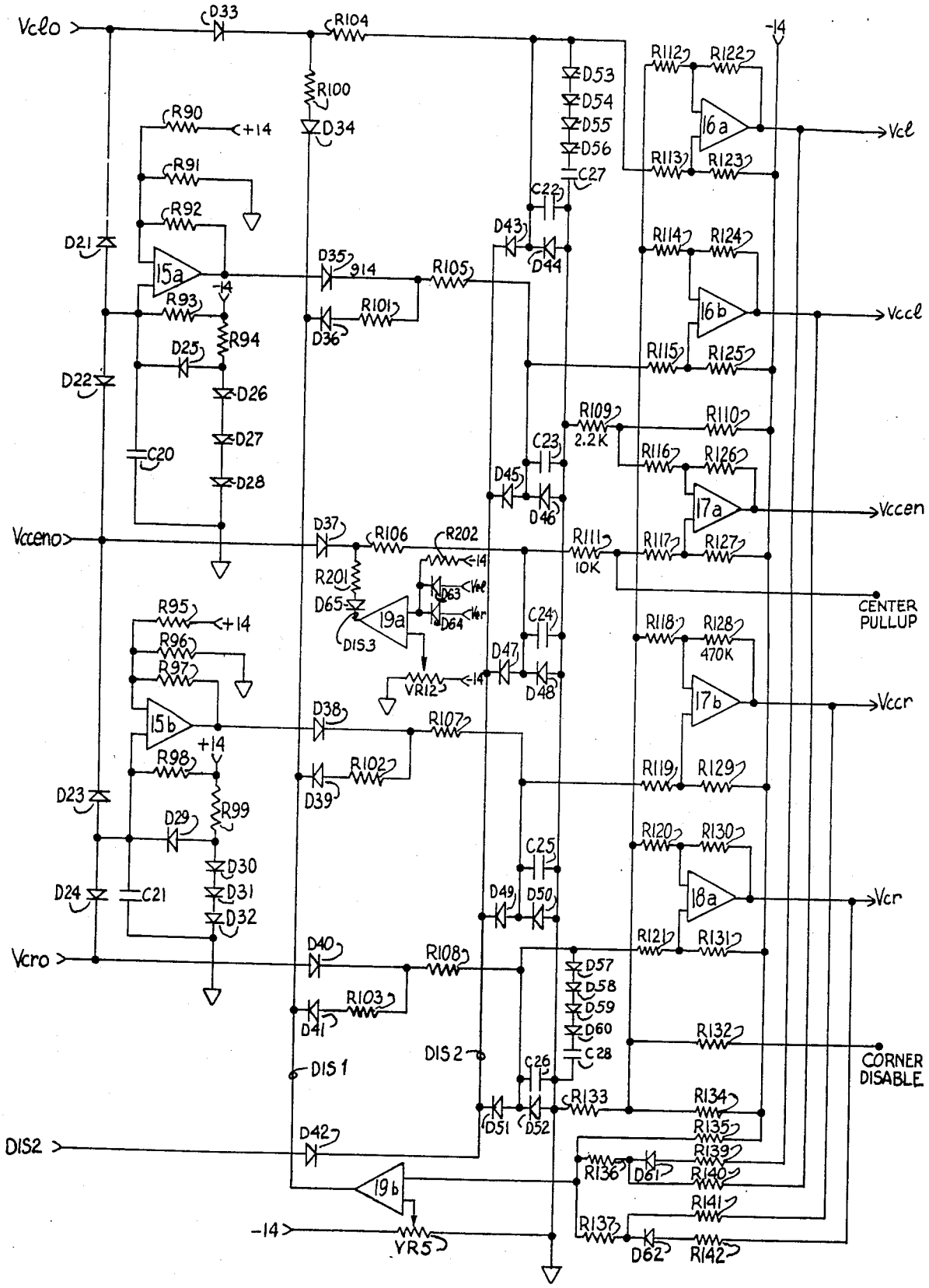

Referring to FIG. 7*e*, Vcclo, the control voltage controlling crosstalk suppression for an incoming stereo center left directional signal, which the preferred embodiment decoder reproduces as left front or $g'_1$, is derived by amplifier 15*a* with D21, D22, D25 through D28; C20 and R90 through R94.

Vccro, which controls crosstalk suppression for an incoming stereo center right signal, which the preferred embodiment decoder reproduces as right front or $g'_2$, is derived by amplifier 15*b* with D23, D24, D29 through D32; C21 and R95 through R99.

Vcclo is derived as follows from Vclo and Vcceno: With a center left signal at the decoder A and B inputs, both Vclo and Vcceno have a value of about 3 volts at the cathodes of D21 and D22, and amplifier 15*a*'s output rises to about 10 volts. When the incoming signal moves either leftward or rightward off center left toward left or toward center, either Vcceno or Vclo decreases from 3 volts toward zero volts, pulling 15*a*'s output Vcclo downward toward zero volts. D21, D22, R93 and C20 provide optional slow attack, fast decay for Vcclo. Optional D25 through D28 and R94 provide the option of variable rise time with varying excursion of Vcclo, with relatively faster initial rise above zero volts, and slower rise approaching the maximum of about 10 volts.

Vccro is derived in an exactly analogous manner from Vcro and Vcceno, substituting amplifier 15*b* and associated components.

It will be recalled from previous discussion relating to enhancement that separation enhancement for incoming center left or center right, to obtain reproduction from respective left front or right front outputs only, is designated "front-corner enhancement", and that this is obtained through use of partial rotation (enhancement) signals supplementing existing partial rotations or enhancements resulting from partially-up left-sensing Vcl and center-sensing Vccen for an incoming center left signal, or right-sensing Vcr and center-sensing Vccen for incoming center right. Specifically, when Vclo and Vcceno are both at approximately 3 volts, representing a center left decoder input, the variable-gain elements (VGE's) controlled by both of these control voltages are partially (nominally about halfway) turned on. The VGE's contolled by Vcclo, therefore, must apply to the decoder's output summers rotation or enhancement signals which, when added to the signals passed by the partially-on Vclo and Vcceno VGE's, result in suppression of the center left incoming signal in all decoder outputs excepting the desired left front. Thus, Vcclo controls application of partial rotation signals (enhancement signals) to the output summers. A similar argument applies to Vccro, which supplements partial enhancement provided by partially-up Vcro and Vcceno for a center right incoming signal, desired to be reproduced by the decoder's right front output only. A more direct technique would have had Vcclo be the only control voltage up for a sensed center left input, and Vccro for sensed center right. This, however, would have required suppressing Vclo and Vcceno when center left is sensed, and Vcro and Vcceno when center right is sensed. The present method of partial enhancement supplementing existing partial enhancement for center left and center right ("front-corner enhancement") requires no extra circuitry to modify the values of existing Vclo, Vcceno or Vcro when front-corner enhancement is added to existing left/center/-right enhancement (modifying the decoder of FIG. 4*a* to that of FIG. 4*b*). Further, the Vcclo and Vccro generators may be treated as an option, and omitted together with the VGE's which they control, resulting in only a partial loss of separation from incoming center left and center right signals, with full separation preserved for incoming left, center and right directional signals. The partial rotation or enhancement method is applicable in general for use in adding enhancement for intermediate positions on a spherical axis (directions).

Fast attack, slow decay time constants for Vclo, Vcclo, Vcceno, Vccro and Vcro are provided by diodes D33, D35, D37, D38, D40 with capacitors C22 through C26 and resistors R104 through R108, R113, R115, R117, R119, R121, R123, R125, R127, R129, R131. Optional D53 through D60 and C27 and C28 provide the option of variable rise time with varying excursions of Vclo and Vcro, with relatively faster initial rise above 0 volts, and slower rise approaching the maximum of about 10 volts.

Level shifting to aid the VC's to control depletion-type FET VGE's is provided by amplifiers 16*a*, 16*b*, 17*a*, 17*b*, 18*a* with R112 through R131; with R109, R110, R133 and R134 providing required reference voltages to the level shifters. At the inputs of the level shifters, control voltages with an "o" suffix have a value of approximately zero volts or lower for "off", or direction not sensed (e. g., stereo left for Vclo, etc.); approximately 3 volts for nominally "halfway on" in accordance with the above-discussed "pre-correction" for FET control non-linearity; approximately 10 volts for "on", meaning that directional information at the decoder inputs corresponding to the particular control voltage (e. g., stereo left for Vclo) dominates in the incoming program. At the outputs of the level shifters, the control voltages (here without the "o" suffix) appear shifted downward by 10 volts so that "off" appears as about −10 volts; "halfway on" as −7 volts; "on" as zero volts.

Level shifters clearly could be omitted given the use of appropriate enhancement-type FET's in place of the present depletion-type. Level shifters may be omitted retaining present use of depletion n-channel FET's by referring the audio (in distinction from sensing and control) circuitry to 10 volts (the nominal maximum excursion of the Vc's prior to level shifting) rather than to ground as now done in FIGS. *7a* through *7f*. In the interest of minimizing noise from such a 10-volt reference in the decoder outputs, non-inverting inputs of the bus driver amplifiers in FIG. *7a*, and of the inverter and summer amplifiers in FIG. *7b*, may be tied to the reference voltage through a decoupling resistor, and heavily shunted to ground for AC by a capacitor. Further, actual potential (nominally 10 volts) on the summing junctions of the output summing amplifiers of FIG. *7b* may be AC-decoupled and used as DC reference for the bus drivers of FIG. *7a*.

Control-voltage discharge or disable employing lines DIS1, DIS2 and DIS3 may be employed to improve decoder performance. DIS1 provides that "forbidden" combinations of control voltages are prevented from being simultaneously full on, which combinations would not have the effect of simultaneously enhancing separation (suppressing crosstalk) from the corresponding directions, but rather, in attempting to enhance separation from two or more different directions at once, would result in loss of separation and/or unwanted changes in decoder output levels (gain riding). An example of a forbidden combination is Vcl and Vcr simutaneously full on. One cause of forbidden simutaneous control voltages is the previously-described fast attack, slow decay circuitry, in which a previously-up Vc may not have had the time to decay when a new Vc comes up in respone to a new dominant directional signal in the incoming program.

To prevent such forbidden combinations, R139 senses Vcl; R140 senses Vccl, R141 senses Vccr; R142 senses Vcr. Resistor-diode logic comprising these resistors in addition to R136, R137, pulldown resistor R135 and D61 and D62, takes into account specific characteristics of the preferred-embodiment matrix and enhancement method as follows: First, as noted, Vccl and Vccr control partial enhancements, in that they are intended to be fully up (10 volts before level shifting; 0 volts after) when others of remaining Vcl, Vccen and Vcr are partly up (e. g., 3 volts before level shifting; −7 volts after). For example, as discussed above, with sensed incoming center left signal, Vccl is fully up, while Vcl and Vccen are both partially up; this is a permissible, and not a forbidden control-voltage combination. On the other hand, Vcl and Vcr being simultaneously up constitutes as forbidden combination causing an overall loss of separation with unwanted overall level variation at the decoder outputs. The mentioned resistor-diode logic takes these permitted and forbidden control voltage combinations into account in sensing which control voltages are up. Further, while prior-art decoding matrices are typically capable of effective separation enhancement for a single direction (position) at a time, in the present preferred embodiment, the condition of both Vccen and either Vcl or Vcr up together results in a degree of simultaneous separation enhancement for an incoming center signal, reproduced as center front, and an incoming left or right signal, reproduced as left back or right back. This is a reason why Vccen need not be sensed by a resistor corresponding for Vccen to R139 through R142 for the other four Vc's. In accordance with the control-voltage information that it receives from the mentioned resistor-diode logic, amplifier **19*b* acts as a voltage comparator and, when forbidden combinations are sensed, discharges slow decay capacitors C22 through C26 as required so that forbidden combinations are eliminated, but any control voltage actually resulting from a direction being sensed (rather than being in slow decay) at the time of the discharge is allowed to remain up. VR5 is a potentiometer for setting the discharge threshold such that individual control voltages or permitted combinations may rise high enough to perform full enhancement; but forbidden combinations cause the comparator to activate and discharge the slow decay capacitors. Discharge time constant is set by optional resistors R100 through R103. For more rapid discharge, the right ends of these resistors may be moved directly to the high side of capacitors C22 through C26**.

The option of discharging Vccen may be obtained either by adding a diode (and resistor) to the DIS1 line to discharge C24; alternatively, a separate DIS3 line for Vccen may use, for example, amplifier **19*a* as a voltage comparator, with D63 and D64 reading Vcl and Vcr, or with other diodes or resistors reading other control-voltage combinations, with R202 as a pulldown resistor, and with R201 and D65 providing the discharge path. VR12 here sets desired discharge threshold as for above VR5**.

The DIS2 line disables all control voltages through D42 and D43, D45, D47, D49, D51 when incoming program level is below a selected threshold as sensed in circuitry of FIG. *7f*.

Referring to FIG. *7f*, sensing of overall (log) program level and attacks (program envelope slope) is provided by amplifiers **12*a*, 12*b*, 13*a* with R56 through R69, D10 and D11, C15 and C16. Amplifier 12*a*** receives positive and negative log halves of the B′ signal from lines c and d from the above-described log circuitry of FIG. *7d*, and differences these logs to yield a voltage proportional to log B. Amplifier **12*b* similarly receives the corresponding logs of the A′ signal from lines a and b, and yields a voltage proportional to log A . To yield a single voltage representing overall log program level, the outputs of amplifiers 12*a* and 12*b* are combined through resistors R65 and R66 an diodes D10 and D11. This results in relative independence of the resulting log-program-level-sensing voltage from the effects of left/right position (direction) in the program material. If amplifier 12*a* and 12*b*** outputs were combined through resistors only, the level-sensing voltage would erroneously rise as a constant-level signal in the incoming program panned from left or right to center; if diodes only were used, the level-sensing voltage would erroneously fall for the same pan.

Amplifier **13*a* with R66 through R69 and C15 and C16 comprise a low-pass filter used to smooth the level-sensing voltage, yielding a voltage representing smoothed program voltage or program envelope. This smoothed voltage is applied to a level sensing amplfier comprising amplifier 13***b*, R71, R72, R73, R76, D14 and C18. A temperature-compensating voltage to correct for variations in logging diode forward voltage with temperature is applied to amplifier 13*b*'s non-inverting input. This temperature-compensating voltage is derived by biasing an unused diode in monolithic array 4 through R13 (FIG. 7*d*), scaling and high-frequency-decoupling the resulting diode forward voltage with the aid of R72, R73 and C18, and applied to the non-inverting input of amplifier 13*b*. The output of 13*b*, representing log program level, is provided to "disable follower" 11*a* through D20 and R89 for fast enable, slow disable in conjunction with capacitor C19. Amplifier 11*a*'s output drives the above-mentioned DIS2 line, disabling the control voltages in FIG. 7*e* when program level drops below a selected threshold. VR2 and VR3 set the disable threshold for respective A and B decoder inputs.

In addition to feeding level-sense amplifier 13*b*, low pass amplifier 13*a* also feeds attack sense (program envelope slope sense) amplifier 14*a*, which, with C17 and R75 comprises a differentiator, with the addition of R70 to limit maximum closed-loop gain. This modification reduces the effect of high-frequency error information (not representing program envelope slopes within a psychoacoustically meaningful range) upon the attack-sense voltage at the output of amplifier 14*a*. Without this, the error information, necessarily present in some degree, would dominate as a component of the attack-sense voltage. At the output of 14*a*, the attack-sense voltage is nominally zero volts for steady-state program material at the decoder inputs, though with musical program, the voltage contains "hash" consisting of quasi-random positive and negative excursions not correlating with audible program attacks and decays. Program attacks (rising envelope slope) cause 14*a*'s output to go positive, while decays cause it to go negative. This attack-sense voltage is applied to speed-control amplifier 14*b* through D12, D13 and R80, which, in conjunction with R74, R83, R84 and D19, create an asymmetrical dead zone placed mainly on the positive side of the origin for the attack-sense voltage. This provides discrimination against the continual low-level error information ("hash"), while passing more substantial pulses representing actual program attacks.

Also fed to speed-control amplifier 14*b* is the log-program-level-sensing voltage at the output of 13*b*. The result of this upon the action of speed-control amplifier 14*b* is that as (log) program level decreases below nominal zero level, an increasingly strong attack is required to raise control-voltage response speed above quiescent speed (previously discussed with reference to FIG. 7*d*). This feature contributes to a smoothness of decoder operation with program material such as symphonic slow movements, while preserving uncompromised speed of localization (separation enhancement) for lively material such as pop records, and even for sudden attacks with symphonic slow movements. Amplifier 14*b*, with R79, R81, R82, R86, R87, R88, D17, D18 and VR4 provides speed control current $i_{speed}$ through R27 to the biasing terminal of transconductance amplifier 9*a* in FIG. 7*d*, providing variable speed response for Va/b. Speed control for other direction-sensing voltages Vx/y may be provided by duplicating the network comprising R79, R86, D17, D18 fed by 14*b*. R79 sets minimum response speed (noted previously as approximately 50 volts/second), while VR4 sets quiescent speed.

All speed control circuitry may be omitted, with appropriate ajustments to fixed time constants (such as increased decay times), for economy purposes. A "corner disable" pin provides for disabling of all enhancement control voltages excepting Vccen when connected to positive supply voltage. With this disable in effect, optionally combined with attenuation preferably of a few dB and/or high-frequency rolloff applied to the back decoder outputs, the preferred-embodiment decoder provides an "ambience recovery" function for music reproduction having superior naturalness in comparison with delay-line ambience devices. While the latter add electronically-generated reverberation to a program without regard for the program's original acoustical environment, the present circuit recovers original acoustical ambience information present in the program itself.

Modifications to the basic matrix-enhancement section as illustrated in FIG. 7, and/or to the sensing circuitry, including spherical-axis rotation as explained above and in the above-referenced Eargle paper, permit the decoding of directional information occupying other than the stereo pan path, preserving if required the advantages of economical direction sensing, improved smoothness and other behavior of the enhancement process through sensing of various program signal characteristics such as program level and program envelope slope, combination of the various sensing signals (voltages), variable time constants, etc. Additionally, the matrix-enhancement section as disclosed or modified from its disclosed embodiments, may be used in conjunction with other sensing methods or differently-derived control signals; the disclosed sensing of various program characteristics and use of resulting control signals in the process of deriving final enhancement control signals (voltages, "Vc's") may be used in conjunction with other than the preferred-embodiment log ratio direction-sensing method or with differently-derived control signals; the direction-sensing method disclosed, and optionally rotated as described so as to be oriented along any desired phase/amplitude axis, may be used to provide information representing relative amplitude and/or phase for other uses. Conversely, the matrix-enhancement method disclosed, affording means to minimize required number of VGE's and/or improved dynamic range/distortion compromise, may be operated from differently or arbitrarily derived control signals in the interest of providing interesting or useful effects.

The basic matrix and enhancement signal circuit portions may be given user-selectable coefficients. The enhancement or rotation process may be made frequency and/or phase dependent by insertion of reactive elements in the circuit in addition to, or in place of, some or all of the coefficient-determining attenuators (resistors) illustrated for the general case in FIG. 5.

FIG. 8 is an embodiment featuring unconditional rejection of a center directional signal (A=B) in the back outputs, which is optimal for decoding of cinema or video material in which such directional signal is used predominantly as a "dialog channel." This embodiment additionally features reverse rotation as described above under the heading "Enhancement", and further employs frequency-response modification listed as item b) in a list of operations a) through d) under the same heading. These two features, in combination with items a), phase shifting, and c), attenuation or boosting, permits the embodiment of FIG. 8 to perform all required enhancements with a single VGE in a version without an optional separation-enhanced center front output; and with two VGE's in a version with such output.

FIG. 8 is similar to FIG's 4*a* and 4*b*, with elements appearing as circles representing attenuators (resistors) or VGE's in conformity with the usage of above FIG's 4. As in FIG's 4, elements 213, 243, 223 and 233 are output summers for respective left front, left back, right back and right front outputs $g'_1$, $g'_3$, $g'_4$ and $g'_2$. Also in conformity with discussion relating to FIG's 4, minus signs in circles are realizable as inverters feeding the appropriate output summers. In FIG. 8, elements 215, 217, 219, 255, 259, 254, 224, 275, 279, 274, 244, 235, 237, 239 concerned with separation enhancement in conjunction with panoramic reproduction of stereo program (as in FIG's 4*a* and 4*b*) are not shown. These elements may be added as shown in FIG's 4*a* and 4*b* when such enhancement is desired for such panoramic reproduction; this is not required when the FIG. 8 embodiment is used in its function as decoder for cinema or video sound encoded according to the "diamond matrix", which provides left, center, right and rear directional signals as disclosed in the present applicant's U.S. Pat. No. 3,632,886. Conversely, elements 301 through 308 appear in FIG. 8, but not in FIG's 4, and are used for reverse-rotation separation enhancement in connection with the mentioned function of decoder for cinema or video sound. Elements 281*a* and 281*b* are switch sections for selecting either this cinema-video sound decode or the panoramic stereo decode; the former is achieved with the switch wipers in the shown "up" position, and the latter, in a "down" position.

As in FIG's 4, attenuators (resistors) 211, 242 and 241, 222 and 221, 231 provide the fixed matrix for respective output summers 213, 243, 223, 233 in accordance with TABLE 3. However, in FIG. 8, attenuator 211 is divided into 211*a* and 211*b*, each having a coefficient of 0.5. Thus, the fixed matrix signal fed to left front output summer 213 is no longer the basic matrix signal, $g_1=A$, as specified in TABLE 3, but rather 0.5(A+B), the output as rotated to reject a back incoming directional signal, A=−B (See discussion of "fixed matrix" and "basic matrix" above, under "Enhancement"). Likewise, attenuator 231 of FIG's 4 is in FIG. 8 divided into 231*a* and 231*b* each having a coefficient of 0.5, and the fixed matrix signal in right front summer 233 is also rotated from its basic matrix condition $g_2=B$ of TABLE 3 to become 0.5(A+B), rejecting back directional signal A=−B. Attenuators 301 and 302 provide a reverse-rotation (enhancement) signal, 0.5(A-B), to VGE 303, which is controlled by control voltage Vcmax-Vccb. Vcmax-Vccb is derived by subtracting back-sensing control voltage Vccb (see above discussion of "Spherical Axis Rotation") from a voltage corresponding to the maximum "on" control voltage excursion, so that when a back incoming directional signal, A=−B, is not sensed, VGE 303 is "on", and when A=−B is sensed, 303 is "off". Thus, when back is not sensed, reverse rotation (enhancement) signal 0.5(A−B) is added to the 0.5(A+B) from 211*a* and 211*b* in left front summer 213, reverse-rotating $g'_1$ from its rotated, to its basic-matrix condition of unity-coefficient A signal specified in TABLE 3. When an incoming back directional signal A=−B is sensed, 303 is off, and $g'_1$ reverts to 0.5(A+B), rejecting the sensed back directional signal. Inverter 308 changes the above reverse-rotation signal, 0.5(A−B), to 0.5(B−A) for analogous use in right front summer 233: When back is not sensed, this 0.5(B−A) is added to the 0.5(A+B) from 231*a* and 231*b* in 233, reverse-rotating $g'_2$ to is basic-matrix condition of unity-coefficient B signal. When back is sensed, 303 is off, and $g'_2$ reverts to 0.5(A+B), rejecting the sensed back directional signal. Thus, through reverse rotation, reproduction of the back signal is suppressed in both front outputs, and thereby is reproduced only in both back outputs, as desired for correct localization.

It was noted in the last paragraph of the discussion relating to FIG's 4 that elements 245, 247 and 249 may be omitted, the coefficients of 225 and 227 made 0.25, and the output of remaining VGE 229 applied to both back summers 243 and 223. This economised enhancement for an incoming A=B directional signal is equally applicable to FIG. 8, and is so shown. With the cinema-video sound decode function selected, switch 281*a* is in its "up" position, so that back output summers 243 and 223 respectively contain 0.75(A−B) and 0.75(B−A) regardless of the status of Vccen. This results in unconditional rejection in the back outputs of a "dialog channel" for which A=B. With this function selected, Vccen-controlled VGE 229 is used only for separation enhancement in conjunction with the addition of optional center front output $g'_{cen}$. Therefore, if neither this optional output nor panoramic stereo decode function is required, VGE 229 may be omitted.

Returning to the enhancement function performed by VGE 303, in cinema-video decode mode (function), switch 281*b*, like above-mentioned 281*a*, is in "up" position. In such case, partial cancellation of the fixed-matrix signal 0.75(B−A) from 222, 221, 225 and 227 in right back summer 223 is provided when back (A=−B) is not sensed and VGE 303 is on, passing 0.5(A−B) from 301 and 302, which is reduced in 304 to 0.25(A−B). When this is combined in 223 with the 0.75(B−A) from said 222, 221, 225 and 227, right back output $g'_4$ is reduced from 0.75(B−A) to 0.5(B−A). This provides an example of gain riding as a sub-case of rotation as discussed above in the general discussion of enhancement. Since left back output $g'_3$ as determined by 242, 241, 225 and 227 in cinema mode is 0.75(A−B), the negative of the 0.75(B−A) of the preceding discussion relating to right back output $g'_4$, the signal from 304 is inverted in inverter 307 prior to application to left back summer 243 to yield equivalent gain riding. The coefficient of 304 may be altered as required from the shown 0.5 in order to vary the range of the gain riding. (Gain-riding, rather than rotation enhancement must be used for the back outputs to meet the requirement of unconditional rejection of A=B dialog-channel information in these outputs.) Reactive element capacitor 305 and resistor 306 may be selected to provide frequency-dependent enhancement, with the enhancement increased above that determined by 304 at higher frequencies as determined by the selected RC time constant of 305 with 306. The amount of increase in enhancement (depth of "shelf" in enhancement frequency characteristic) depends on the enhancement-signal current passed by 306 in comparison with 304.

If panoramic stereo decoding is not required, and cinema-video sound decode mode is to be the only function of the FIG. 8 decoder, summer 243, attenuators 242 and 241 and inverter 307 may be omitted, and left back output signal $g'_3$ obtained by inverting right back output signal $g'_4$.

Element 253 is the output summer for an optional separation-enhanced center front output, $g'_{cen}$. Attenuators 251 and 252 provide fixed matrix components 0.5(A+B) for the output. VGE 229, already required in panoramic stereo decoding to suppress a center (A=B) directional signal in the back outputs, here additionally suppresses the center signal in the left front and right front outputs, as is desirable when the optional center front output is used to reproduce this signal. Switch sections 282*a* and 282*b* are put in their "up" positions to select the use of the optional output. The same enhancement signal, -0.25A-0.25B, provided by 225 and 227 and used to obtain complete suppression of the center A=B directional signal in the back outputs (summers 243 and 223), is passed by switch section 282*a* when the optional output is selected, and added also to front summers 213 and 233 when a center (A=B) incoming directional signal is sensed, turning VGE 229 on. The result is that left front output $g'_1$ is changed from A as determined by 211*a*, 211*b* and 301 and 301 through 303 (reverse rotation), to 0.75A-0.25B. Similarly, right front output $g'_2$ is reduced from B as determined by 231*a*, 231*b* and 301 and 302 through 303, to 0.75B−0.25A. This operation on the front outputs in response to sensed incoming center, gives a reduction of 6 dB in the level of the center signal in the left front and right front outputs, in addition to the existing basic matrix separation, localizing the center signal at the center front output (speaker). Full cancellation of this signal in these outputs may be achieved by feeding more enhancement-signal current from switch 282*a* to summers 213 and 233, but this would result in left front and right front both "going mono" to 0.5(A−B) and 0.5(B−A), respectively, when center is sensed; therefore the exampled moderate, rather than complete enhancement is preferred.

Enhancement signal −0.25A−0.25B passed by 229 in response to sensed center is additionally passed through element 309 having a coefficient of −2. The resulting 0.5(A+B) is added to the 0.5(A+B) from 251 and 252 in center output summer 253, resulting in a 6 dB boost to the center output when a center directional signal is sensed. Amount of boost may be adjusted by adjusting the coefficient of 309. As stated with reference to FIG's 4, the minus sign may be realized in an inverter feeding the output. The shown numerical value of 2 for this coefficient does not suggest that element 309 has absolute gain. It is merely an attenuator (resistor) which passes twice the current to its summer (253) as would such an attenuator having a numerical coefficient of unity. As for above FIG's 4, resistors or other elements may in practice be interposed between elements shown in the Figures, and may not be shown provided that signal components summed in the output summers have the indicated coefficients; for example, the signal paths connecting switch 282*a* to respective summers 213 and 233 will in practice contain resistors which are not shown, since summed A and B coefficients are the 0.25's indicated at elements 225 and 227.

Switch section 282*b*, linked to 281*a*, enables the optional center output simultaneously with the enablement of its separation enhancement by 281*a*.

The embodiment of FIG. 8 illustrates the use of frequency-dependent separation enhancement and of reverse rotation for further reduction in required number of variable-gain elements for separation enhancement, in addition to the techniques illustrated with reference to the embodiments of FIG's 4 and 7. A single VGE controlled by a single (front-back) direction-sensing control voltage provides optimal separation-enhanced decoding of cinema or video sound when four outputs are used; and a second VGE suffices for the addition of separation-enhanced center front output, the second VGE and associated passive elements being those already required for center enhancement in a panoramic mode.

As the electronic art advances, alternative means for deriving substantially the information specified herein for sensing and control or related signal processing use may be substituted; for example, digitally-performed division deriving the ratio A/B may be substituted for the preferred-embodiment log ratio means. This, and other substitutions which may realise improved economy in the current state of the art are contemplated.

While in this explanation some theoretical considerations have been advanced as reasons for the distinctive structural features of the apparatus, the overriding consideration for the structural design of the apparatus is performance in attaining clear and realistic directional sound reproduction based upon actual experimental apparatus evaluation and the results thereof. Accordingly the scope of the invention is not to be considered to be limited by any theoretical explanations presented. While such theoretical explanations are believed to be correct, the operation of the system of the invention is not primarily predicated on theoretical factors but rather on performance of operable electronic structures.

In addition to the various modifications, and alternative embodiments of the invention which have been presented, other variations and modifications to the apparatus will be apparent to those skilled in the art, and accordingly the scope of the invention is not to be considered to be limited to the particular embodiments, variations and alternatives shown or suggested, but is rather to be determined by reference to the appended claims.

APPENDIX

The circuits described with reference to FIG's *7a* through *7f* may be constructed using conventional circuit components having desired values. The circuits may be of discrete components or may utilize integrated circuits of monolithic or hybrid construction. As an example of functional construction, the circuits of FIG's *7a* through *7f* were constructed from the following circuit components:

| | | | | | |
|---|---|---|---|---|---|
| FIG. 7a | | R148 | 39 k | R182 | 1. k |
| Amplifiers: | | R149 | 24 k | R183 | 33 k |
| 1a, 1b | ½ 5532 | R150 | 360 | R184 | 68 k |
| 2a, 2b | ½ 5532 | R151 | 39 k | R185 | 1 k |
| Resistors: | | R152 | 24 k | R186 | 10 k |
| R1, R2 | 22 k | R153 | 360 | R187 | 4.7 k |
| R3-R8 | 39 k | R154 | 10 k | R188 | 1 k |
| FIG. 7b | | R155 | 360 | R189 | 470 |
| Amplifiers: | | R156 | 11 k | R190 | 33 k |

-continued

| | |
|---|---|
| 20a, 20b | ½ 5532 |
| 21a, 21b | ½ 5532 |
| 22a, 22b | ½ 5532 |
| 23a, 23b | ½ 5532 |
| Transistors: | |
| Q1–Q6 | 2N5951 |
| Potentiometers: | |
| VR6–VR11 | 47 k |
| Resistors: | |
| R143 | 11 k |
| R144 | 18 k |
| R145 | 360 |
| R146 | 10 k |
| R147 | 360 |
| FIG. 7d | |
| Diode array: | |
| 4 | CA3039 |
| Amplifiers: | |
| 3a, 3b | ½ LF353 |
| 5a–5d | ¼ LF347 |
| 6a, 6b | ½ CA3280 |
| 7a, 7b | ½ LF353 |
| 8a, 8b | ½ LF353 |
| 9a, 9b | ½ CA3280 |
| 10a, 10b | ½ LF353 |
| Diodes: | |
| D1–D4 | 1N914 |
| D5, D6 | 1N4739A |
| D7–D9 | 1N914 |
| Capacitors: | |
| C1, C2 | 25 uF |
| C3, C4 | .02 2% |
| C5, C6 | 56pF 2% |
| C7, C8 | .1 2% |
| C9 | .0012 |
| C10 | .1 |
| C11, C12 | .022 |
| C13 | .47 |
| Pentiometers: | |
| VR1 | 47 k |
| Resistors: | |
| R9, R10 | 39 k |
| R11, R12 | 330 k |
| R13 | 1.5 M |
| R14, R15 | 1 k |
| R16–R19 | 3.3 k |
| R114 | 470 k |
| R115 | 4.7 M |
| R116 | 470 k |
| R117 | 4.7 M |
| R118 | 470 k |
| R119 | 4.7 M |
| R120 | 470 k |
| R121 | 4.7 M |
| R122 | 470 k |
| R123 | 4.7 M |
| R124 | 470 k |
| R125 | 4.7 M |
| R126 | 470 k |
| R127 | 4.7 M |
| R128 | 470 k |
| R129 | 4.7 M |
| R130 | 470 k |
| R131 | 4.7 M |
| R132 | 180 |
| R133 | 2.2 k |
| R134 | 4.7 k |
| R135 | 43 k |
| R136, R137 | 33 k |
| R139 | 62 k |
| R140, R141 | 82 k |
| R142 | 62 k |
| R201 | 220 |
| R202 | 33 k |

Figure 7F:
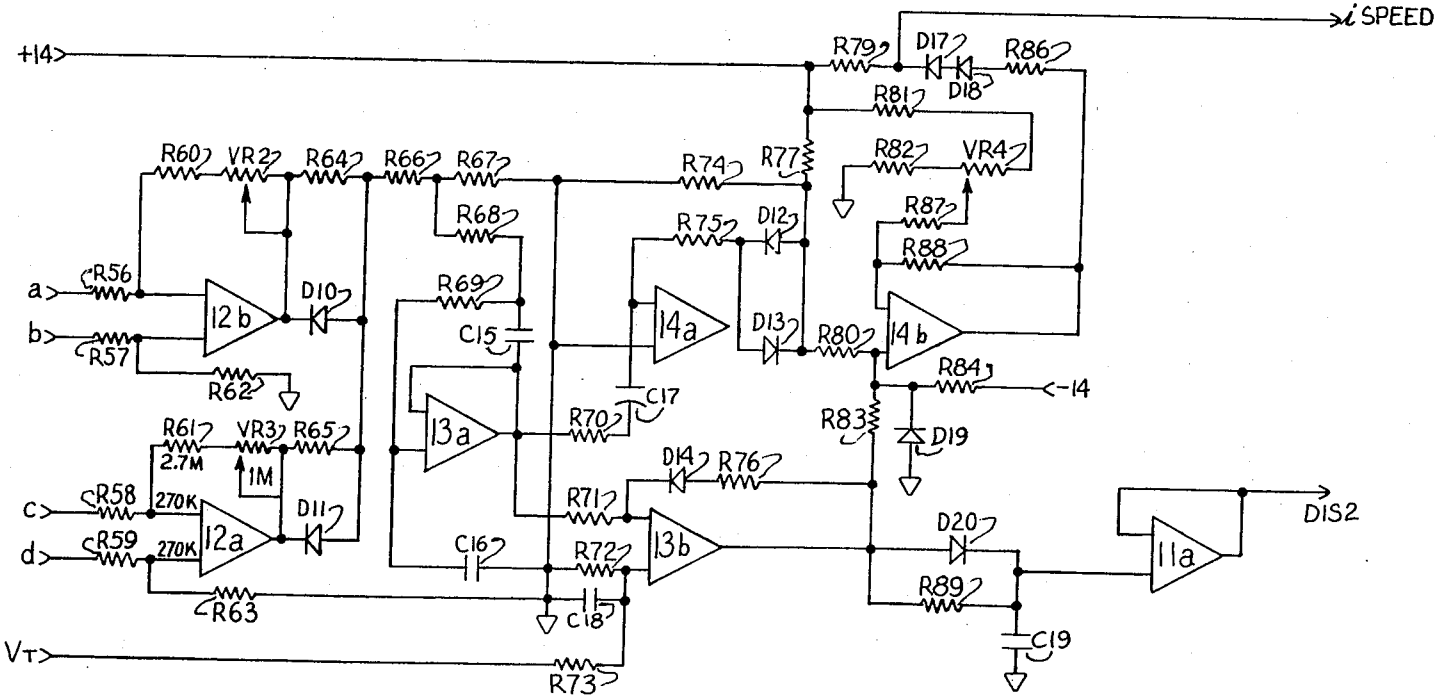

| | |
|---|---|
| R157 | 18 k |
| R158 | 360 |
| R159–R170 | 4.7 M |
| R171 | 33 k |
| R172 | 470 |
| R173 | 1 k |
| R174 | 10 k |
| R175 | 15 k |
| R176 | 1 k |
| R177 | 33 k |
| R178 | 68 k |
| R179 | 1.2 k |
| R180 | 10 k |
| R181 | 4.7 k |
| R20 | 2.2 M |
| R21 | 130 k |
| R22, R23 | 10 k 1% |
| R24, R25 | 27 k |
| R26 | 100 k |
| R27 | 150 k |
| R28 | 470 k |
| R29 | 100 k |
| R30, R31 | 47 k |
| R32 | 6.8 k |
| R33 | 100 |
| R34 | 150 k |
| R35 | 240 k |
| R36 | 150 k |
| R37 | 390 k |
| R38 | 30 k |
| R39 | 100 k |
| R40, R41 | 27 k |
| R42 | 100 k |
| R43 | 150 k |
| R44 | 30 k |
| R45 | 47 k |
| R46 | 39 k |
| R47 | 330 k |
| R51, R52 | 100 k |
| FIG. 7e | |
| Amplifiers: | |
| 15a, 15b | ½ 1458 |
| 16a, 16b | ½ LF353 |
| 17a, 17b | ½ LF353 |
| 18a | ½ LF353 |
| 19a, 19b | ½ 1458 |
| FIG. 7f | |
| Amplifiers: | |
| 11a | ½ 1458 |
| 12a, 12b | ½ LF353 |
| 13a, 13b | ½ LF353 |
| 14a, 14b | ½ LF353 |
| Diodes: | |
| D10–D20 | 1N914 |
| Capacitors: | |
| C15 | .012 |
| C16 | .0056 |
| C17 | 6.8 uF |
| C18 | .022 |
| C19 | .22 |
| Potentiometers: | |
| VR2, VR3 | 1 M |
| VR4 | 2.2 k |
| Resistors: | |
| R56–R59 | 270 k |
| R60–R63 | 2.7 M |
| R64, R65 | 4.7 k |
| R66, R67 | 10 k |
| R68, R69 | 220 k |
| R70 | 10 k |
| R71 | 2.7 k |
| R72 | 10 M |
| R73 | 1 M |
| R74 | 4.7 k |
| R75 | 1 M |
| R76 | 270 k |
| R77 | 220 k |

| | |
|---|---|
| R191 | 10 k |
| R192 | 15 k |
| R193 | 20 k |
| R194 | 100 k |
| R195 | 20 k |
| R196 | 47 k |
| R197 | 20 k |
| R198 | 47 k |
| R199 | 20 k |
| R200 | 100 k |
| FIG. 7c: | |
| Array 4 | CA3039 |
| Diodes: | |
| D21–D41 | 1N914 |
| D42 | ECG142A |
| D43–D65 | 1N914 |
| Capacitors: | |
| C20, C21 | 4.7 uF |
| C22, C23 | .027 |
| C24 | .1 |
| C25, C26 | .027 |
| C27, C28 | .047 |
| Potentiometers: | |
| VR5, VR12 | 47 k |
| Resistors: | |
| R90 | 1.5 M |
| R91 | 100 k |
| R92 | 220 k |
| R93 | 330 k |
| R94 | 100 k |
| R95 | 1.5 M |
| R96 | 100 k |
| R97 | 220 k |
| R98 | 330 k |
| R99 | 100 k |
| R100–R103 | 220 |
| R104 | 100 k |
| R105–R107 | 6.8 k |
| R108 | 100 k |
| R109 | 2.2 k |
| R110 | 4.7 k |
| Rlll | 10 k |
| R112 | 470 k |
| R113 | 4.7 M |
| R80 | 100 k |
| R81 | 27 k |
| R82 | 4.3 k |
| R83 | 470 k |
| R84 | 510 k |
| R86 | 5.6 k |
| R87 | 220 k |
| R88 | 1.5 M |
| R89 | 470 k |

-continued

| | |
|---|---|
| R79 | 1 M |

What is claimed is:

1. A multi-directional sound system for producing multi-directional sound signals derived from received A and B stereo channels having a detectable momentary program level and having direction signals therein comprising a decoder having A and B inputs and including a stereo signal buss having conductors provided with A channel signals and B channel signals a plurality of fixed attenuator elements connected to receive said A or B channel signals, a plurality of variable gain elements having a variable response time, at least four channel amplifiers each with a plurality of summing junction inputs, said fixed attenuator elements being connected to couple and attenuate the A and B channel signals to said summing junction inputs, at least some of said summing junction inputs being connected to receive a signal from a conductor of said buss through one of said variable gain elements whereby the amplitude relationship of said A and B channel signals at the summing junction is varied in response to a control signal input to said variable gain element, and position sensing means responsive to said A and B inputs to produce a control voltage signal representative of dominance of a first direction signal over a second opposite direction signal, said control voltage signal being transmitted to the input of selected ones of said variable gain elements, means for detecting the momentary program level of at least a portion of said decoder A and B inputs, and means for controlling said response time of said variable gain element as a function of said momentary program level, said variable gain elements being connected to deliver the A and B channel signals at least in part to the input of some of said attenuator elements with the result that the input at the summing junction of at least some of said channel amplifiers has in part passed through a series combination of at least one of said variable gain elements and two of said attenuator elements.

2. Apparatus as recited in claim 1 wherein said position senssing means includes a function generator for producing a log function of each of said direction signals and means for taking the difference of said log functions.

3. Apparatus as recited in claim 1 wherein said position sensing means includes means for producing a log first direction signal and a log second direction signal representative of the logs of the instantaneous amplitudes of said first direction and second direction signals respectively, means for subtracting one of said log signals from the other to produce a log difference signal having a d.c. component representing the log ratio of a common signal component of said log first direction and log second direction signals, means for separating the d.c. component and the a.c. ripple component from said log difference signal, and means for processing said d.c. component and said a.c. component to produce control voltage signals transmitted to said variable gain elements for modifying the effective amplitude relationships of said decoder.

4. A multi-directional sound system for producing multi-directional sound signals derived from received A and B stereo channels having direction signals therein comprising a decoder having A and B inputs and including a stereo signal buss having conductors provided with A channel signals and B channel signals, a plurality of fixed attenuator elements connected to receive said A and B channel signals, a plurality of variable gain elements, each having a control input, an audio input and an audio output, at least four channel amplifiers including a left back and a right back channel amplifier each with a plurality of summing junction inputs, said fixed attenuator elements being connected to couple and attenuate said A and B channel signals to said summing junction inputs, at least some of said summing junction inputs being connected to receive an audio signal from at least one conductor of said buss through one of said fixed attenuator elements and a specific one of said variable gain elements and a different audio signal through one of said fixed attenuator elements but not through said specific one of said variable gain elements, whereby the A to B amplitude relationship at the last said summing junction inputs is varied in response to a control input to said variable gain element, position sensing means responsive to said A and B inputs producing a control voltage signal representative of dominance of a first one of said direction signals over a second spatially opposite one of said direction signals, said control voltage signal being transmitted to the control input of selected ones of said variable gain elements, the audio output of at least a selected one of said variable gain elements being connected to supply the audio input signal at least in part through an inverter element to the inputs of some of said summing junctions to cause the inputs at the summing junctions of two different ones of said channel amplifiers to have inputs from a single one of said variable gain elements with one of said inputs being inverted relative to the other, and switch means for selectively connecting said left back and right back channel amplifiers to said fixed attenuator elements and said variable gain elements in a manner to cause the same total signal, disregarding phase, to be supplied to each of said left back and right back channel amplifiers.

5. Apparatus as recited in claim 4 wherein said position sensing means includes a function generator for producing a log function of each of said direction signals and means for taking the difference of said log functions.

6. Apparatus as recited in claim 4 wherein said variable gain elements have a variable response time, said A channel signals and B channel signals having detectable momentary program levels and including means for detecting the momentary program level of at least a portion of the decoder signal inputs and means for controlling said response time as a function of said program level.

7. Apparatus as recited in claim 4 wherein said position sensing means includes means for producing a log first direction signal and a log second direction signal representative of the logs of the instantaneous amplitudes of said first direction and second direction signals respectively, means for subtracting one of said log signals from the other to produce a log difference signal having a d.c. component representing the log ratio of a common signal component of said log first direction and log second direction signals, means for separating the d.c. component and the a.c. ripple component from said log difference signal, and means for processing said d.c. component and said a.c. ripple component to produce control voltage signals transmitted to said variable gain elements for modifying the effective amplitude relationships of said decoder.

* * * * *